US007223124B2

(12) United States Patent
Nakamura et al.

(10) Patent No.: US 7,223,124 B2
(45) Date of Patent: May 29, 2007

(54) CONNECTOR AND A METHOD OF ASSEMBLING IT

(75) Inventors: Keiichi Nakamura, Yokkaichi (JP); Ryotaro Ishikawa, Yokkaichi (JP); Hajime Kawase, Yokkaichi (JP); Yutaka Kobayashi, Yokkaichi (JP); Takahiro Yoneda, Sagamihara (JP); Ryo Sawada, Kawasaki (JP); Ken Yoshimura, Torrance, CA (US)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/344,860

(22) Filed: Feb. 1, 2006

(65) Prior Publication Data

US 2006/0172597 A1 Aug. 3, 2006

(30) Foreign Application Priority Data

Feb. 2, 2005 (JP) ..... 2005-026567

(51) Int. Cl.
*H01R 13/40* (2006.01)

(52) U.S. Cl. ..... 439/595

(58) Field of Classification Search ..... 439/595
See application file for complete search history.

(56) References Cited

U.S. PATENT DOCUMENTS 4,405,112 A * 9/1983 Doubleday et al. ..... 249/207
4,998,896 A * 3/1991 Lundergan ..... 439/595
5,100,346 A * 3/1992 McCardell ..... 439/595
5,336,540 A 8/1994 Kato et al.
5,839,921 A 11/1998 Yamanashi
6,551,145 B2 4/2003 Kurimoto et al.
6,589,079 B2 7/2003 Kashiyama et al.
6,626,702 B2 9/2003 Kurimoto et al.

FOREIGN PATENT DOCUMENTS

DE 101 62 586 A1 7/2002

* cited by examiner

*Primary Examiner*—Truc T. Nguyen
(74) *Attorney, Agent, or Firm*—Gerald E. Hespos; Anthony J. Casella

(57) ABSTRACT

A front wall (50) is movable between a full locking position and a partial locking position on the front of a female housing (10). When the front wall (50) is at the full locking position, mating tabs (70) can enter main portions (41) of the female terminal fittings (40) through tab insertion holes (51) of the front wall (50) for contacting resilient contacts (45) and an unlocking jig can be inserted into a mold-removal hole (14) of the female housing (10) through a jig insertion hole (52) of the front wall (50) to disengage a lock (12). When the front wall (50) is at the partial locking position, detection probes (60) can be inserted into the jig insertion holes (52) of the front wall (50) for contacting detecting plates (46) offset from resilient contacts (45) in main portions of the female terminal fittings (40).

8 Claims, 21 Drawing Sheets

CONNECTOR AND A METHOD OF ASSEMBLING IT

BACKGROUND OF THE INVENTION

1. Field of the Invention

The invention relates to a connector and a method of assembling it.

2. Description of the Related Art

A female connector has a housing formed with cavities for receiving female terminal fittings and a lock is formed at a side surface of each cavity for retaining the female terminal fitting in the cavity. The retained female terminal fitting is connected with a tab of a male terminal fitting inserted through a front opening of the cavity.

Mold-removal holes are left in the front surface of the housing as the locks are formed. Thus, leading ends of the tabs may erroneously enter the mold-removal holes if the male and female connectors are not positioned properly during connection. Erroneous insertion of the tabs has become more common in view of recent trends to miniaturize connectors. Accordingly, there is a demand for a connector that makes such erroneous insertion unlikely.

A terminal fitting to be accommodated in the cavity of the female connector generally has a tubular main portion with a front end and a tab insertion opening in the front end. A barrel is arranged behind the box portion and can be crimped into connection with an end of a wire. A resilient contact is folded back from the front end of the main portion and into the main portion.

A tab of a male terminal fitting enters the tubular main portion through the tab insertion opening when the female connector is connected properly with a mating male connector. Thus, the tab contacts the resilient contact to establish an electrical connection therebetween (see e.g. U.S. Pat. No. 5,336,540).

An electrical connection test for the female connector is carried out by inserting an electrically conductive probe through the tab insertion opening of the female terminal fitting to directly contact the resilient contact of the female terminal fitting. However, the probe could permanently set or plastically deformed the resilient contact.

The present invention was developed in view of the above problem and an object thereof is to avoid the erroneous insertion of a tab.

Another object of the invention is to avoid damaging the resilient contact during an electrical connection test.

SUMMARY OF THE INVENTION

The invention relates to a connector with a housing that has at least one cavity for receiving a terminal fitting. A lock is formed at an inner wall of the cavity and is configured to engage the terminal fitting. A mold-removal hole is formed in the front wall of the housing as the lock is being formed, and hence substantially aligns with the lock. A mating tab can be inserted into the cavity from the front for connection with the terminal fitting in the cavity. A flat plate-shaped front wall is mountable at the front of the housing and has at least one tab insertion hole that can communicate with the cavity. The mating tab is inserted through the tab insertion hole of the front wall and into the cavity of the housing as the connectors are connected. However, the tab cannot be inserted into the mold-removal hole.

The terminal fitting preferably has a main portion for receiving the tab and a resilient contact is in the main portion for contacting the tab. A detecting portion is at a position on the main portion different from the resilient contact and enables an electrical connection test to be performed.

The front wall preferably has at least one jig insertion hole for permitting insertion of an unlocking jig to disengage the lock from the terminal fitting.

The front wall preferably is held on the housing for movement between a partial locking position and a full locking position. The detecting portion substantially faces the jig insertion hole when the front wall is at the partial locking position. Thus, a jig for an electrical connection test can be inserted into the jig insertion hole from the front and can contact the detecting portion when the front wall is at the partial locking position.

The tab insertion hole communicates with the cavity and the jig insertion hole communicates when the mold-removal hole when the front wall is at the full locking position. Thus, a tab can pass through the tab insertion hole when the front wall is at the full locking position and can enter the main portion for contacting a resilient contact of a terminal fitting that has been inserted properly into the cavity. Additionally, an unlocking jig can pass through the jig insertion hole when the front wall is at the full locking position and can enter the mold-removal hole for displacing the lock in an unlocking direction.

The jig for the electrical connection test can be inserted through the jig insertion hole and into contact with the detecting portion when the front wall is at the partial locking position on the housing. The detecting portion is at a position different from the resilient contact. Thus, the electrical connection test can be conducted without touching the resilient contact, and the resilient contact will not be damaged by the probe during the electrical connection test.

The jig insertion hole of the front wall permits passage of the unlocking jig when the front wall is at the full locking position and permits passage of the jig for electrical connection test when the front wall is at the partial locking position. Thus, it is not necessary to separately form both holes in the front wall, and the front wall can be the simpler and smaller.

A front opening of the tubular main portion of the terminal fitting and the tab insertion hole of the front wall are displaced from each other when the front wall is at the partial locking position. Thus, the leading end of the jig for electrical connection test does not enter the main portion if the jig for electrical connection test is inserted inadvertently into the tab insertion hole. Thus, the contact of the jig and the resilient contact can be avoided.

The main portion preferably is formed with a detecting plate for at least partly covering the front opening of the main portion except an area where the tab passes. The detecting portion preferably is on the front surface of the detecting plate. Thus, a large area of contact is assured for the jig for electrical connection test and the detecting portion to increase the reliability of the electrical connection test.

The front wall may be joined to be integrally or unitarily with the housing by at least one hinge, thereby meeting a demand for fewer parts.

The front wall can be rotated about the hinge to a rotation ending position on the front surface of the housing. Thus, the front wall can be mounted on the front surface of the housing through one movement, thereby improving mounting operability.

A retainer mount hole is formed in a side surface of the housing for receiving a retainer that will retain a terminal fitting is at least partly mountable. The front wall can be rotated about 90° in an opening direction from the rotation ending position to an initial position. Thus, the tab insertion hole and the retainer mount hole are open in the substantially same direction when the front wall is at the initial position. Thus, the tab insertion hole can be formed by a mold for forming the retainer mount hole merely by setting the posture of the front wall at the initial position while molding the housing. Therefore, the mold can be simplified.

A frame preferably is mounted on the front surface of the housing for covering the side edges of the front wall. Thus, the side edges of the front wall are protected by the mounting frame, and the front wall cannot be detached inadvertently from the front surface of the housing by external matter.

At least one part of a surface of the front wall around the tab insertion hole can function as a front stop wall for the terminal fitting when the terminal fitting is being inserted into the cavity.

The invention also relates to a method of assembling a connector. The method includes providing a housing with at least one cavity, inserting at least one terminal fitting into the cavity, and engaging a lock formed in the cavity with the terminal fitting to lock the terminal fitting. The method also includes mounting a front wall on the front surface of the housing. The step of mounting the front wall on the housing may include mounting the front wall at a partial locking position, performing an electrical connection test and then moving the front wall to a final locking position so that a mating tab can be inserted into the cavity for connection with the terminal fitting.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female housing according to a first embodiment of the present invention is identified by the numeral 10 in FIGS. 1 to 15. The female housing 10 is connectable with a male housing (not shown). In the following description, a side to be connected with the male housing is referred to as the front.

Figure 8:
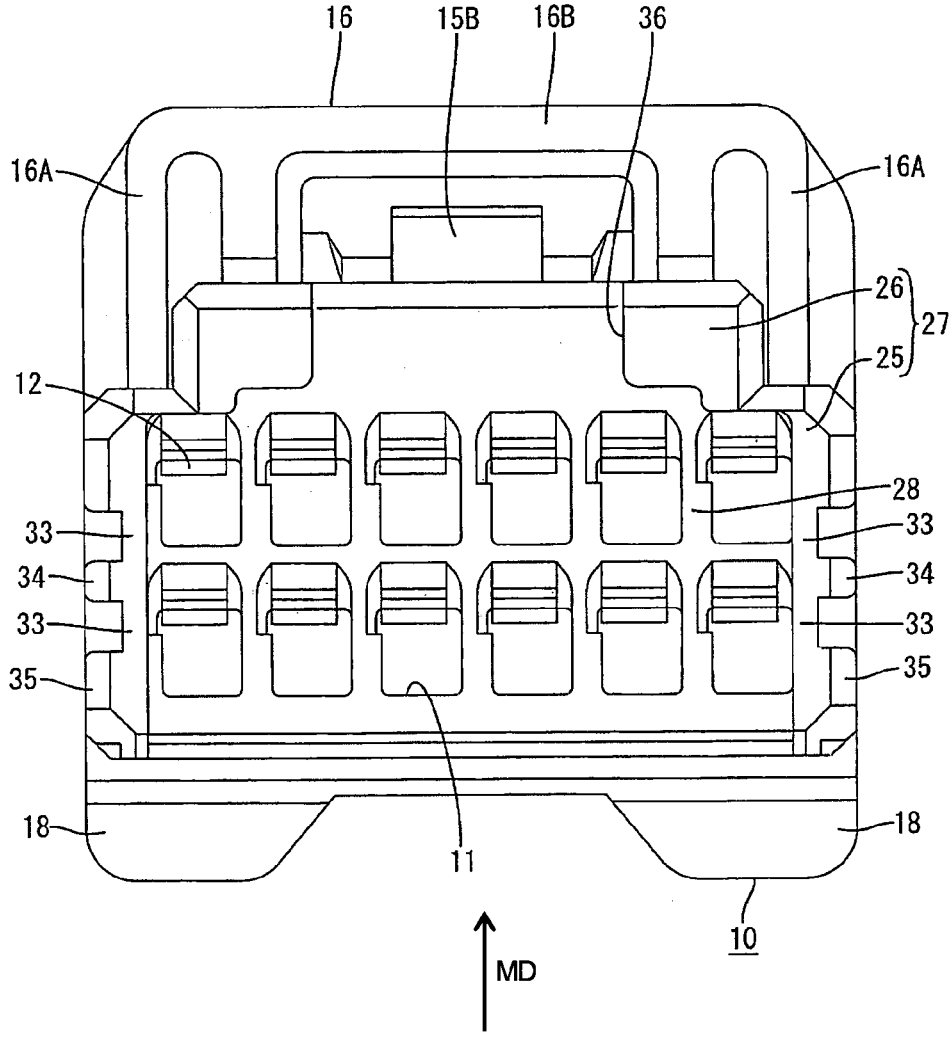
FIG. 8 is a front view of a female housing.

The female housing 10 is made e.g. of a synthetic resin substantially into a block preferably having a wide cross section. As shown in FIG. 8, the female housing 10 is formed internally with cavities 11 at upper and lower stages. The cavities 11 penetrate the female housing 10 substantially in forward and backward directions FBD. Female terminal fittings 40 can be accommodated into the cavities 11 from behind, and front openings of the cavities 11 permit the passage of tabs 70 of male terminal fittings at least partly accommodated in the male connector housing.

Figure 3:
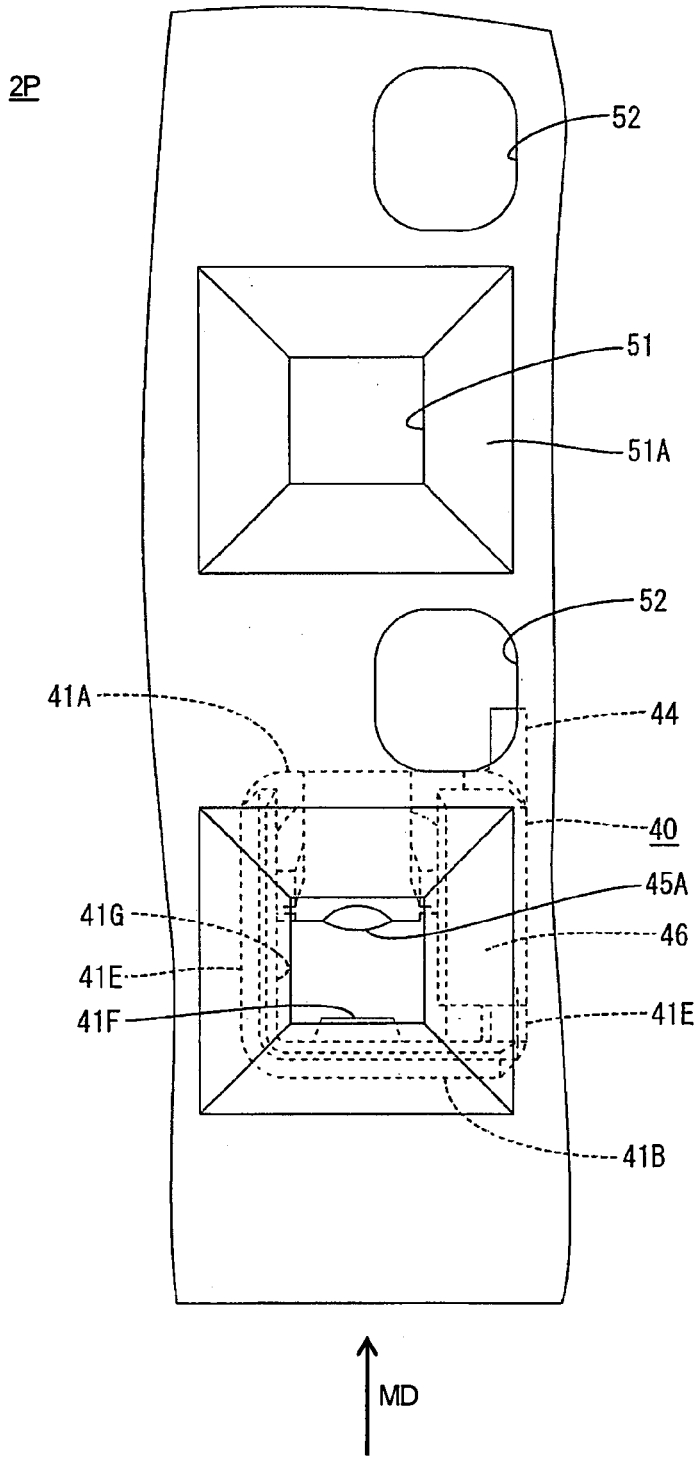
FIG. 3 is an enlarged front view showing an essential portion when the front wall is at the full locking position.
Figure 4:
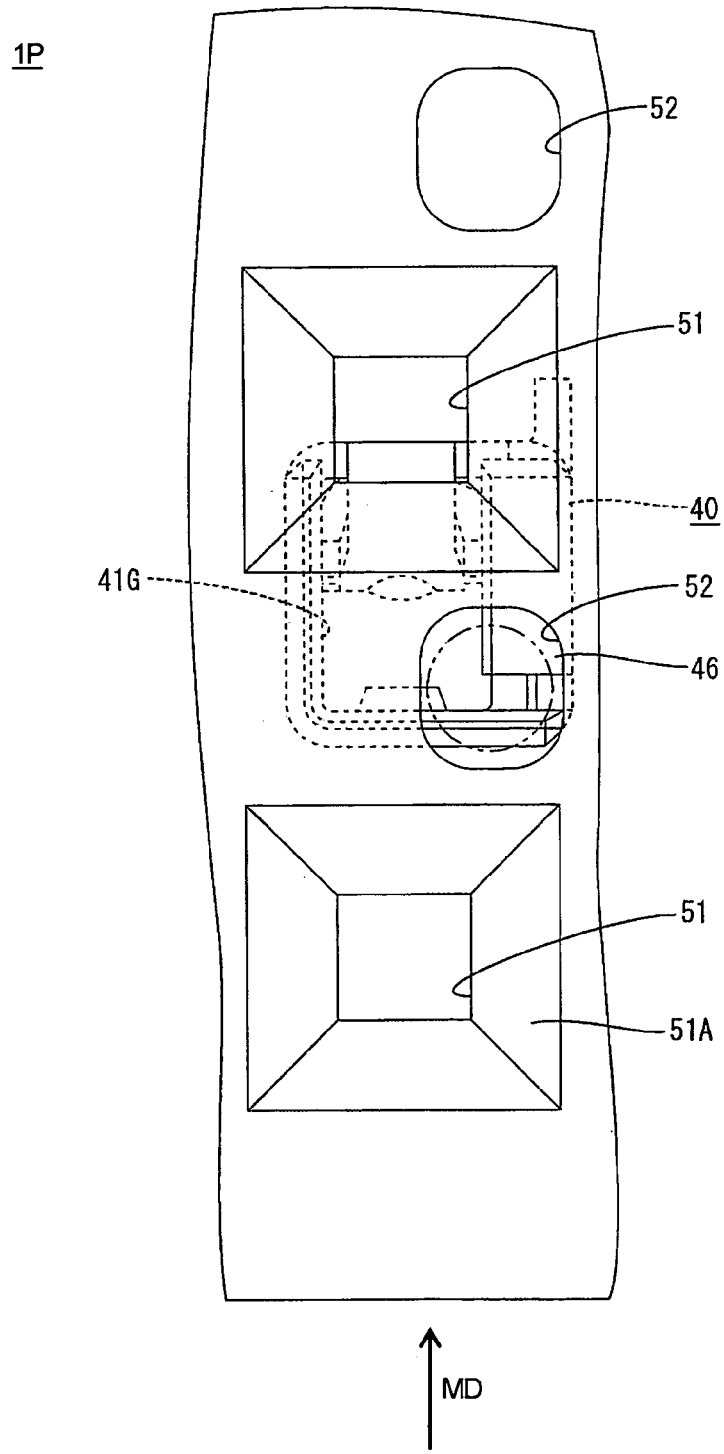
FIG. 4 is an enlarged front view showing an essential portion when the front wall is at the partial locking position.
Figure 5:
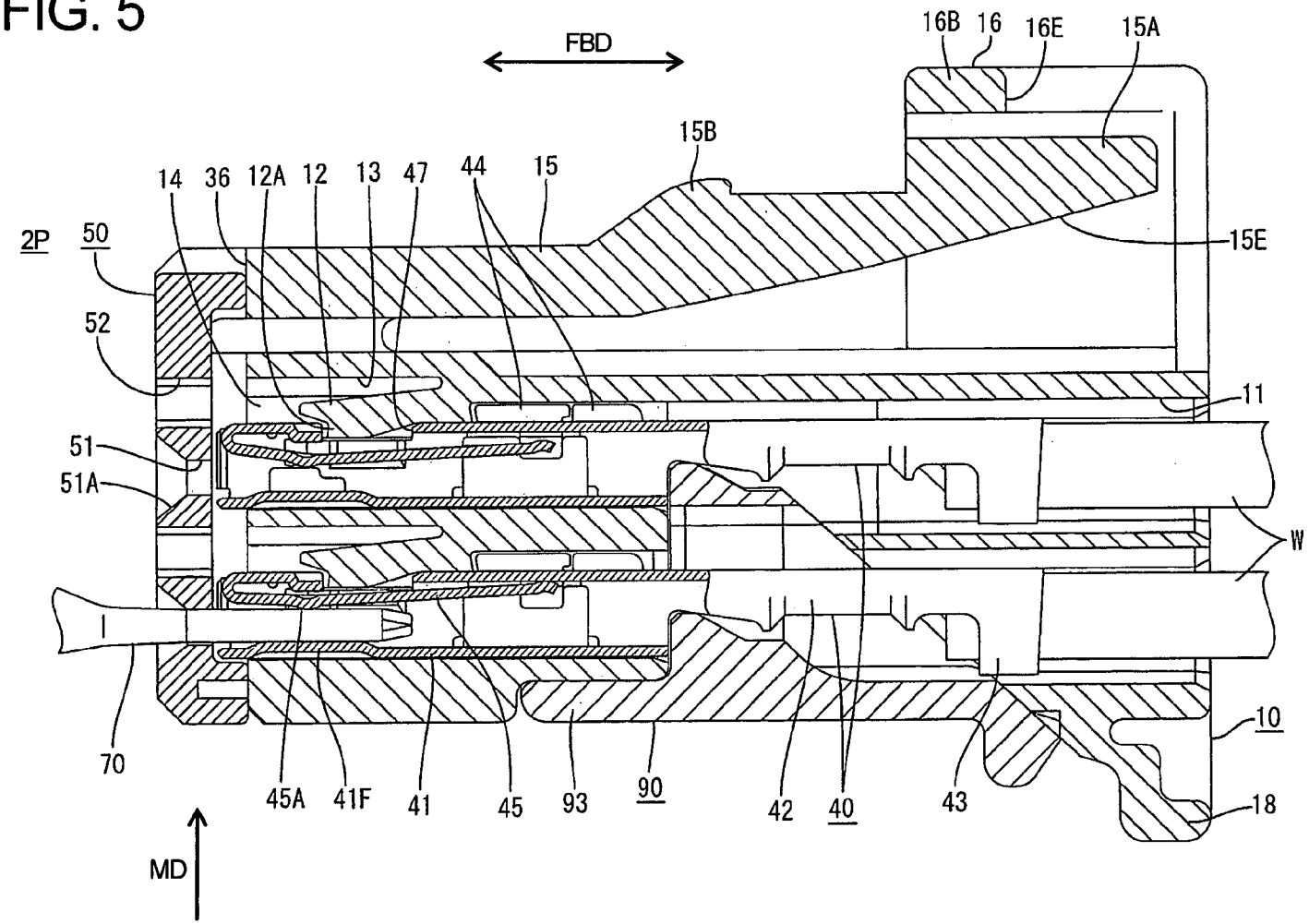
FIG. 5 is a section of the connector when the front wall is at the full locking position and connection with a tab is established.

Each female terminal fitting 40, as shown in FIG. 5, is formed unitarily and has opposite front and rear ends. A main portion 41 is at the front end and a wire connection portion is at the rear end. The wire connection portion has a wire barrel 42 and an insulation barrel 43 that are configured to be crimped, bent or folded into connection with a wire W. The main portion 41 is formed into a box of substantially rectangular cross section by bending, folding and/or shaping an electrically conductive metal sheet in a width direction. More particularly, the main portion 41 has a ceiling plate 41A, a bottom plate 41B and left and right side plates 41E, as shown in FIG. 3. A stabilizer 44 projects up from one of the side plates 41E. The stabilizer 44 can slide in contact with an escaping groove (not shown) formed along one corner of the upper surface of each cavity 11 to prevent an improper (e.g. upside-down) insertion of the female terminal fitting 40 because of an unmatched positional relationship of the stabilizer 44 and the escaping groove when the female terminal fitting 40 is inserted improperly oriented (e.g. upside down).

A resilient contact 45 is cantilevered from the front of the ceiling plate 41A and is bent back into the main portion 41. The resilient contact piece 45 has an angled side view and is resiliently deformable up and down in a direction intersecting an inserting direction of the mating tab 70 into the main portion 41. A contact point 45A with the mating tab 70 projects at the tip of the resilient contact 45 to squeeze and contact the tab 70 in cooperation with a receiving portion 41 F formed inwardly on the bottom plate 41B.

The base end of the resilient contact 45 is joined to the front end of the ceiling plate 41A at a position deviated to one side (to left in FIG. 3) from the widthwise center, and slants as it extends back. A tab insertion opening 41G is formed at part of the front of the main portion 41 at a position immediately above the base end of the resilient contact 45 and hence toward one side from the widthwise center. A detecting plate 46 closes a remaining part of the front end of the main portion 41 near the tab insertion opening 41G. The detecting plate 46 has a vertically long rectangular front view, and is formed by bending a forward projecting portion of the right side plate 41E shown in FIG. 3 inwardly at a substantially right angle. When the female terminal fitting 40 is viewed from the front, the base end of the resilient contact 45 is located adjacent to the detecting plate 46.

As shown in FIG. 5, a lock 12 is formed unitarily at the upper surface of each cavity 11 of the female housing 10. The lock 12 cantilevers substantially forward along the forward and backward directions FBD and is resiliently deformable up and down in a direction intersecting a mounting direction of the terminal fitting 40 into the cavity 11. A locking projection 12A extends from the free end of the lock 12 and projects towards the cavity 11. A deformation space 13 is defined above the lock 12. At least one mold-removal hole 14 is left in the front surface of the female housing 10 as the lock 12 is formed. More particularly, the mold removal hole 14 is before the lock 12 and the deformation space 13, and communicates with the cavity 11. The lock 12 interferes with the female terminal fitting 40 during insertion of the female terminal fitting 40 into the cavity 11. As a result, the lock 12 is deformed up into the deformation space 13. The lock 12 is restored resiliently when the female terminal fitting 40 is inserted properly so that the locking projection 12A engages a locking hole 47 formed in the ceiling plate 41A to retain the female terminal fitting 40.

A lock arm 15 is formed at the widthwise center of the upper surface of the female housing 10. The lock arm 15 cantilevers back substantially along the forward and backward directions FBD with the base end thereof supported on the front end of the upper surface of the female housing 10. An operable portion 15A is provided at or close to the free end of the lock arm 15 and a lock projection 15B is formed at a substantially longitudinal middle position of the upper surface of the lock arm 15. The lock projection 15B can be engaged with the male connector housing to hold the housings together.

A slanted surface 15E is defined on the lower side of the lock arm 15 behind the longitudinal middle and a rear area of the upper surface of the female housing 10 facing the slanted surface 15E is lowered slightly as compared to a front area. Thus, a sufficient deformation space for the lock arm 15 is ensured between the rear area of the lock arm 15 and the rear area of the upper surface of the female housing 10. Deformation spaces 13 for the locks 12 are formed inside the front area of the upper surface of the female housing 10 to reduce the height of the female housing 10.

Figure 9:
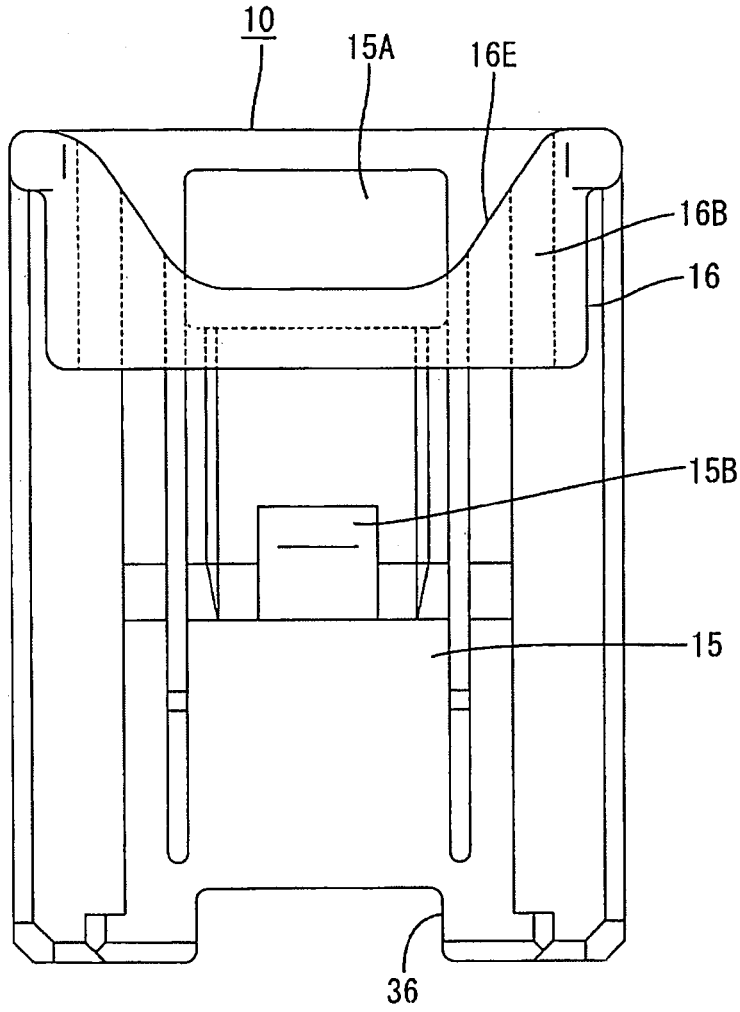
FIG. 9 is a top plan view of the female housing.

A turning preventing wall 16 projects on the upper surface of the female housing 10 and at least partly surrounds the operable portion 15A of the lock arm 15. The turning preventing wall 16 is substantially gate-shaped and has two legs 16A connected with the opposite ends of the upper surface of the female housing 10 and a ceiling portion 16B spanning between the legs 16A. The operable portion 15A is arranged inside the turning preventing wall 16. The turning preventing wall 16 prevents the lock arm 15 from being turned up when the lock arm 15 gets caught by external matter such as by a looped wire W. As shown in FIG. 9, the ceiling portion 16B of the turning preventing wall 16 is notched to form a operating hole 16E so that a finger can push the operable portion 15A.

Figure 10:
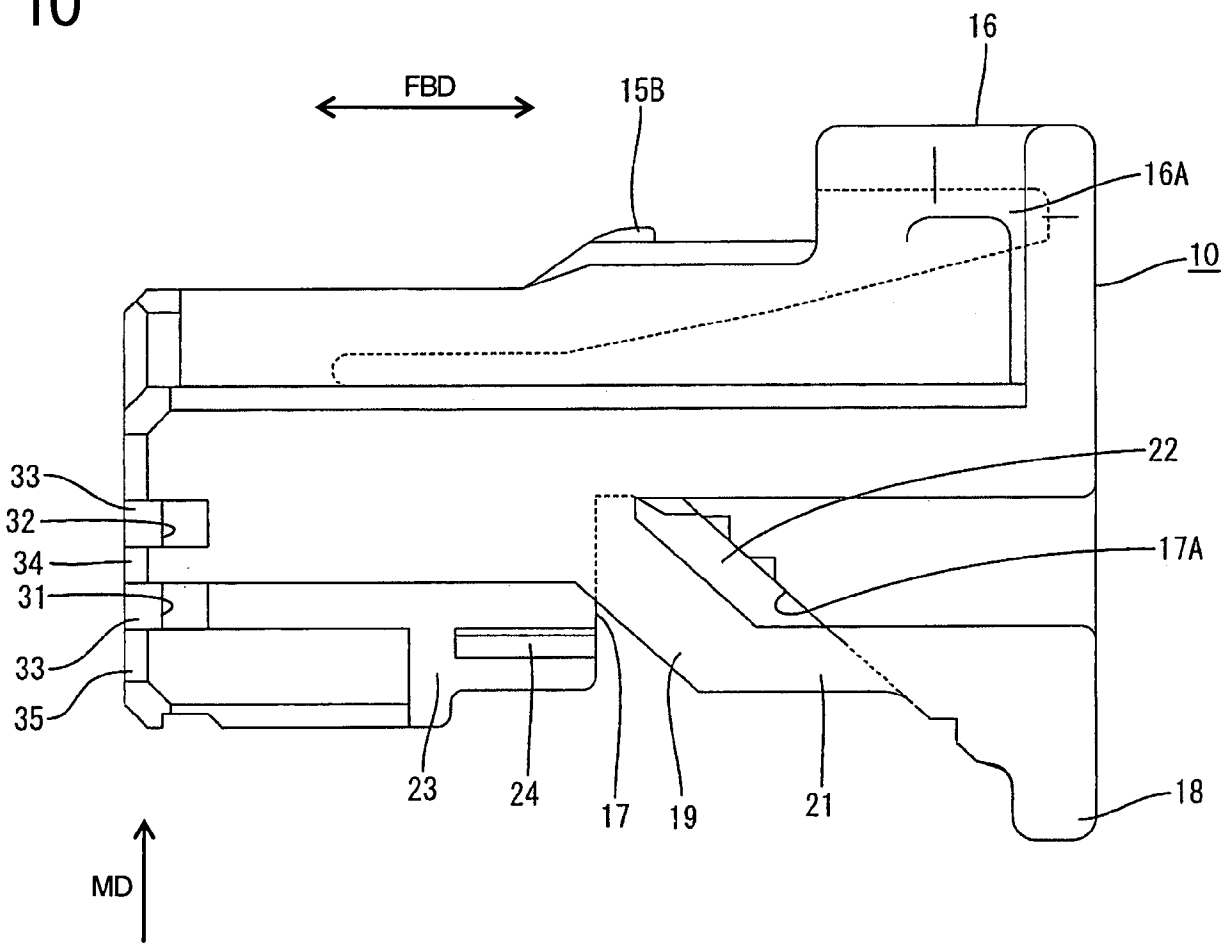
FIG. 10 is a side view of the female housing.

As shown in FIG. 10, a retainer mount hole 17 is formed in three surfaces of the female housing 10 and extends from the bottom surface to the opposite side surfaces. The retainer mount hole 17 has a depth to communicate with the respective cavities 11, thereby dividing the cavities 11 at the upper and lower stages into front and rear parts. The retainer mount hole 17 has inclined rear edges 17A that incline up and to the front on the opposite side surfaces of the female housing 10. Oblique finger placing projections 18 are formed at or close to the rear end of the bottom surface of the female housing 10 substantially continuous with the inclined edges 17A.

Guide ribs 19 are on the opposite side surfaces of the female housing 10. The guide ribs 19 extend substantially parallel with the inclined edges 17A and partly cover the openings of the retainer mount hole 17. Each guide rib 19 is an elongated plate with a first shorter side connected with the front upper end of the opening of the retainer mount hole 17 and with a second shorter side connected with a restricting wall 21. The restricting wall 21 spans substantially horizontally between the second shorter side of the guide rib 19 and the front bottom end of the inclined edge 17A. A guide hole 22 is defined between the guide rib 19 and the inclined edge 17A. Locking projections 24 extend substantially in forward and backward directions FBD on recessed surfaces 23 slightly retracted from peripheral areas of the opposite side surfaces of the female housing 10 before the retainer mount hole 17.

The connector further includes a retainer 90 made e.g. of a synthetic resin similar to the female housing 10. The retainer 90 includes a retainer main body 92 that can fit into the retainer mount hole 17 and supporting plate 93 bulges out substantially forward from the bottom end of the retainer main body 92.

The retainer main body 92 is formed with as many window frames 94 as the cavities 11 at each stage of the female housing 10. The respective window frames 94 are formed to substantially align with the cavities 11 at the lower stage of the female housing 10. The front opening edges of the respective window frames 94 are substantially vertical to conform to the rear opening edges of the front parts of the respective divided cavities 11. The rear opening edges of the window frames 94 have an inclination substantially corresponding to the inclination of the front opening edges of the rear parts of the divided cavities 11.

The retainer 90 is movable between a partial locking position and a full locking position. When the retainer 90 is at the partial locking position, the lower and upper surfaces of the respective window frames 94 are substantially at the substantially same heights as the bottom surfaces of the corresponding cavities 11 to permit insertion and withdrawal of the female terminal fittings 40. On the other hand, if the retainer 90 is moved to the full locking position, end surfaces of the respective window frames 94 oppose rear edges of the main portions 41 of the female terminal fittings 40 to lock the female terminal fittings 40 doubly in cooperation with the locks 12. Engaging projections 91 are formed substantially along the inclination of the rear surfaces of the respective window frames 94 on the opposite side surfaces of the retainer main body 92.

The supporting plate 93 of the retainer 90 is dimensioned to substantially fully close the opening of the retainer mount hole 17 in the bottom surface of the female housing 10 when the retainer 90 is at the full locking position. Two standing plates 95 project substantially vertically from the opposite ends of the supporting plate 93. The standing plates 95 are spaced apart sufficiently to hold the opposite recessed side surfaces 23 of the female housing 10, and are deformable in and out to change a spacing therebetween. The rear edges of the standing plates 95 are arranged to extend substantially along the front edges of the guide ribs 19 of the female housing 10, and the guide ribs 19 are held between the standing plates 95 and the engaging projections 91. Engaging projections 96 are formed on the inner surfaces of the upper ends of the standing plates 95 to substantially face each other.

The engaging projections 96 of the retainer 90 contact the lower surfaces of the locking projections 24 of the female housing 10 when the retainer 90 is at the partial locking position to prevent any further oblique upward movement of the retainer 90. Simultaneously, the engaging projections 91 contact the upper edges of the restricting walls 21 to prevent the retainer 90 from coming off. The engaging projections 96 move onto the locking projections 24 in the process of moving the retainer 90 to the full locking position and the standing plates 95 deform to widen the spacing therebetween. The standing plates 95 are restored towards their initial postures and the engaging projections 96 engage the upper surfaces of the locking projections 24 when the retainer 90 reaches the full locking position, thereby holding the retainer 90 at the full locking position.

As shown in FIG. 8, a mounting frame 27 is formed on the front surface of the female housing 10 and has a substantially gate-shape defined by opposite side walls 25 and an upper wall 26. A substantially flat plate-shaped front wall 50 made e.g. of a synthetic resin is fit from below and along a mounting direction MD into the mounting frame 27 along the front surface of the female housing 10.

Figure 11:
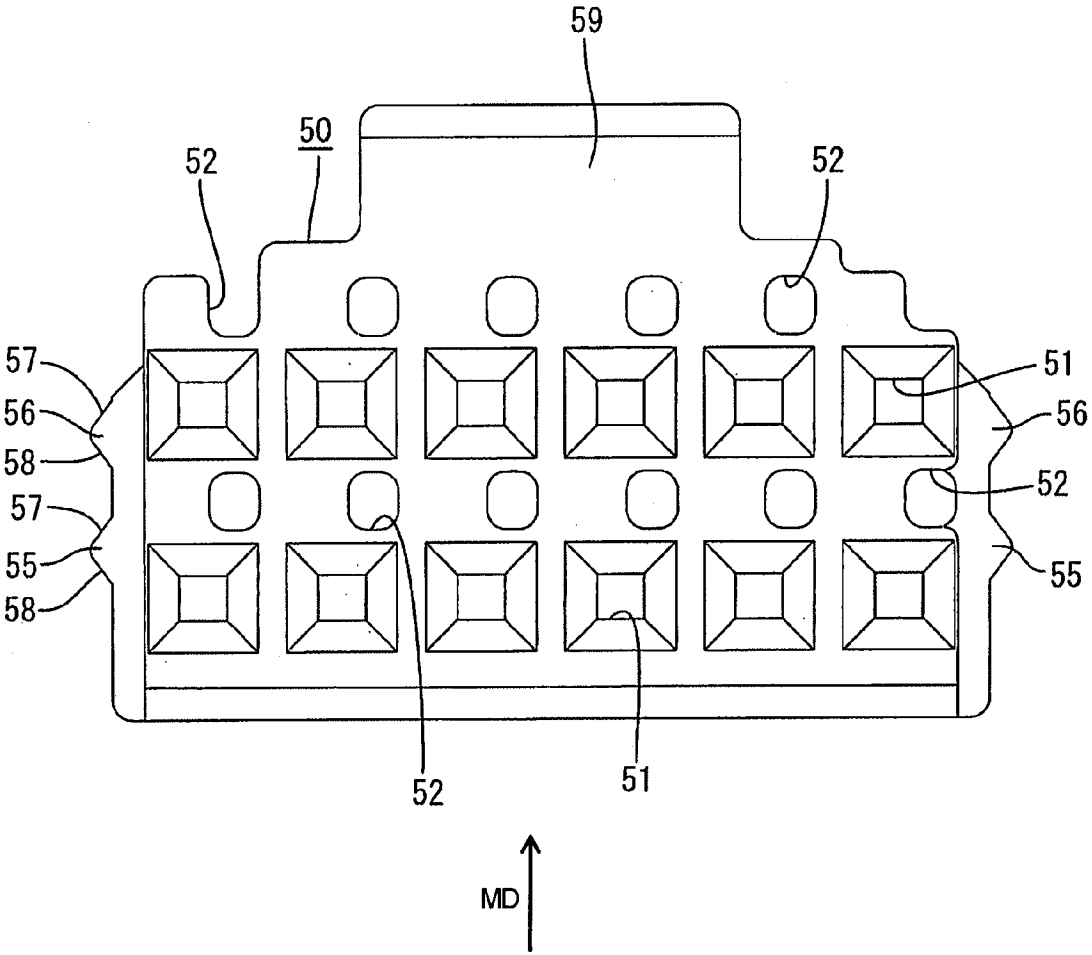
FIG. 11 is a front view of the front wall.

As shown in FIG. 11, the front wall 50 is formed with as many tab insertion holes 51 as the respective cavities 11. The tab insertion holes 51 are arranged along the width direction at upper and lower stages and can communicate with the corresponding cavities 11. The tab insertion holes 51 are dimensioned to be held in sliding contact with the tabs 70 to guide the tabs 70 to the corresponding cavities 11. The front wall 50 also is formed with jig insertion holes 52 that can communicate with the mold-removal holes 14. The jig insertion holes 52 are arranged at upper and lower stages and have an offset positional relationship along the mounting direction MD with the respective tab insertion holes 51. The jig insertion hole 52 at the left end in FIG. 11 of the upper stage opens in the upper end of the front wall 50.

Figure 12:
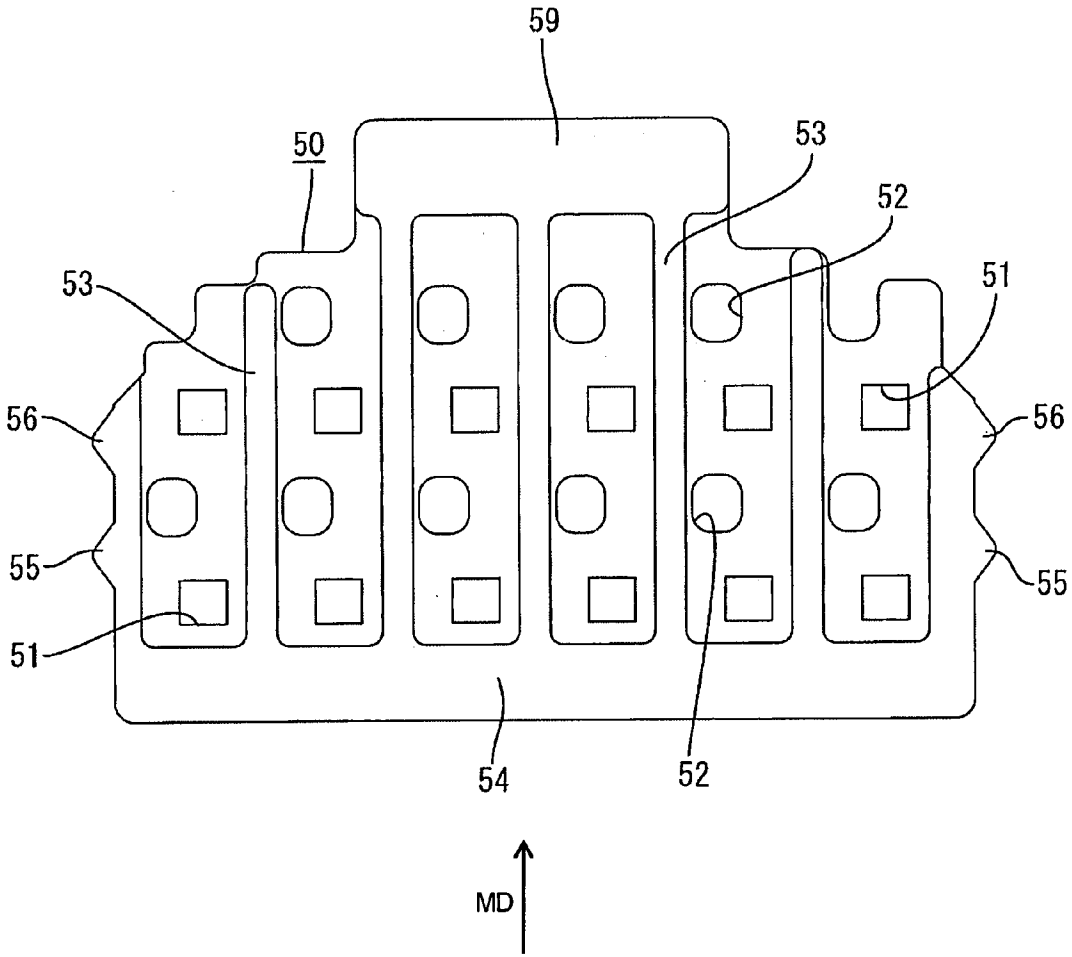
FIG. 12 is a rear view of the front wall.
Figure 13:
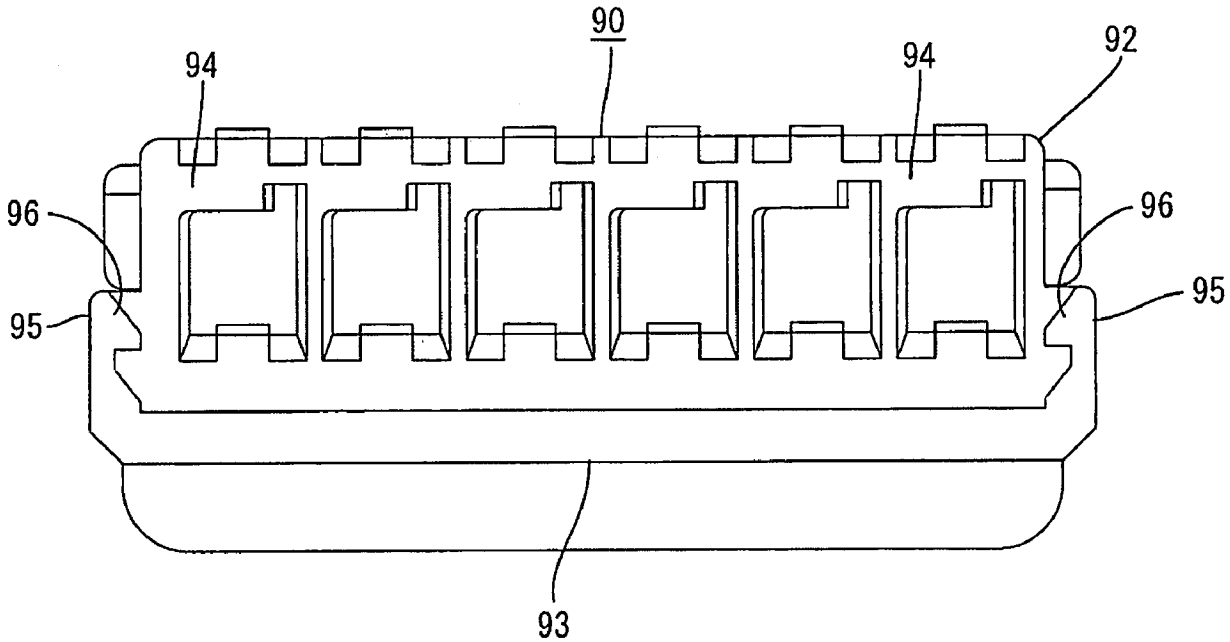
FIG. 13 is a front view of a retainer.
Figure 14:
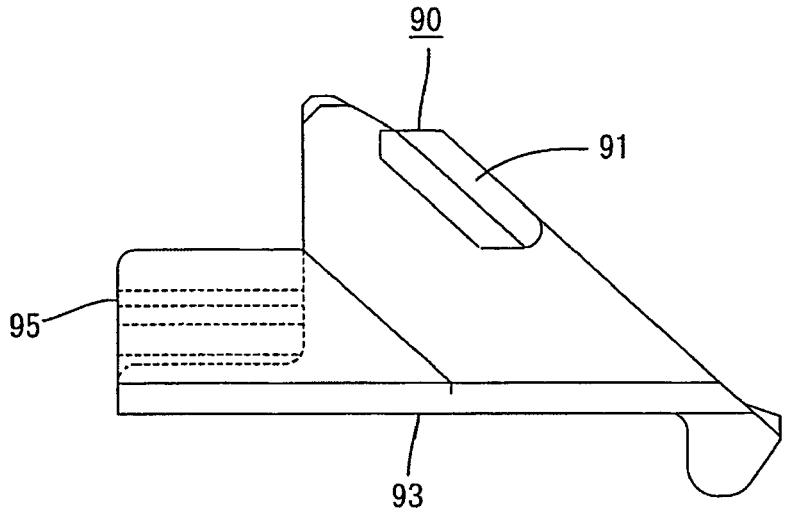
FIG. 14 is a side view of the retainer.
Figure 15:
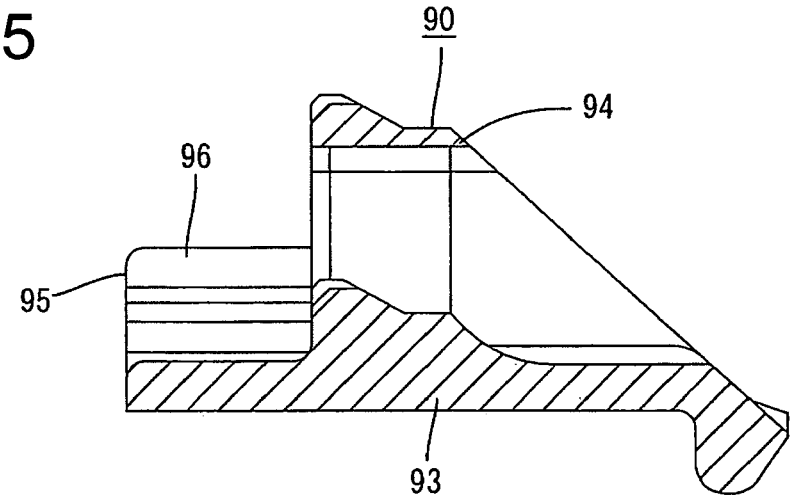
FIG. 15 is a section of the retainer.
Figure 16:
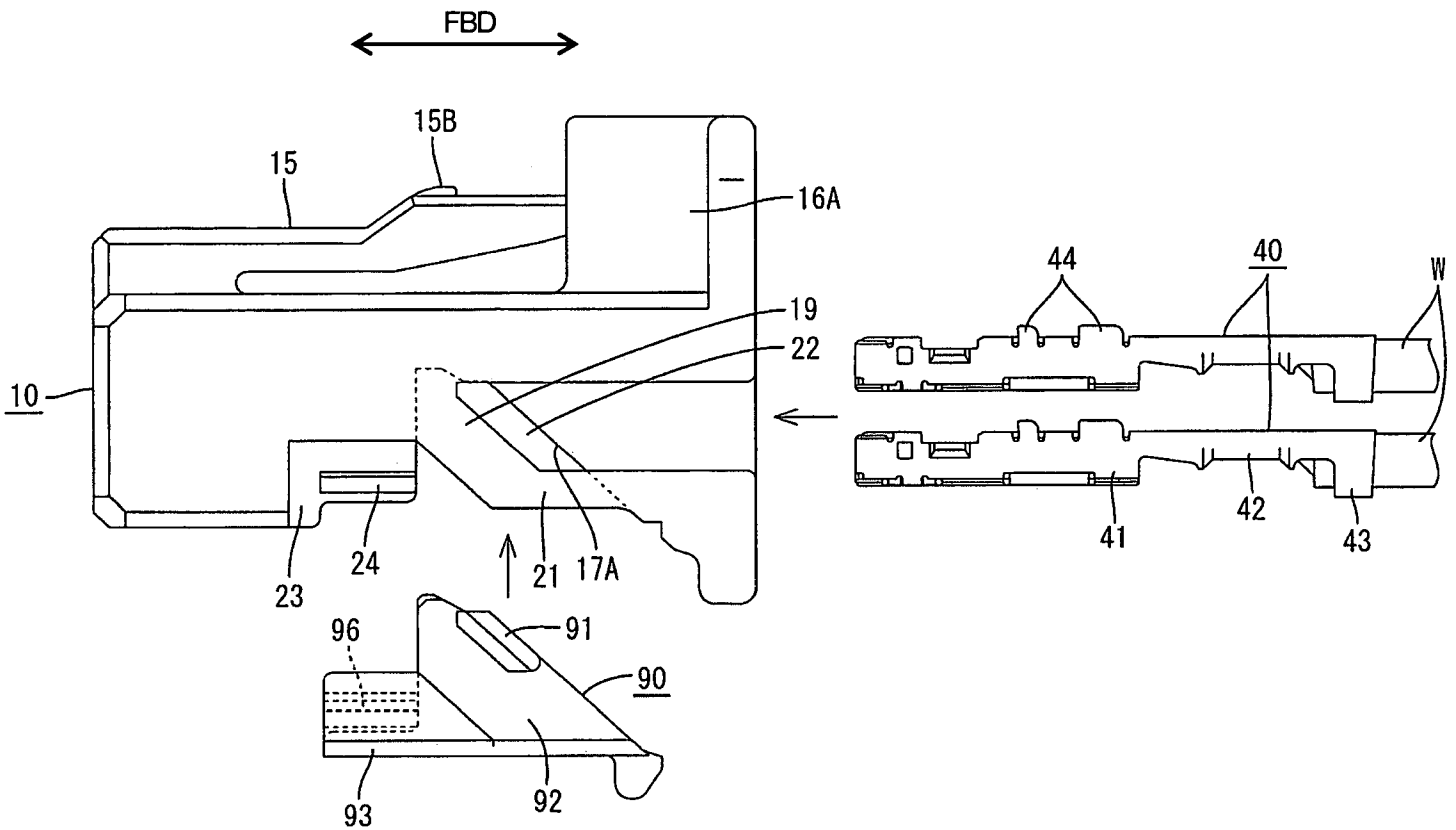
FIG. 16 is an exploded side view of a connector according to a second embodiment of the invention.

As shown in FIG. 12, ribs 53 are formed substantially side by side on the rear surface of the front wall member 50 and extend substantially vertically along the mounting direction MD. The ribs 53 can be connected with partition walls 28 partitioning the cavities 11 in the female housing 10. A base 54 bulges out backward from the bottom end of the rear surface of the front wall 50, and the base ends of the vertical ribs 53 are coupled to the upper surface of this base 54.

Two first latches 55 are formed at the opposite side edges of the front wall 50 at substantially the same height, and two second latches 56 are formed above and at a specified distance to the first latches 55. The first and second latches 55, 56 have identical shapes and sizes. The latches 55, 56 have slanted upper surfaces 57 that incline down towards the projecting ends and slanted lower surfaces 58 that incline upward toward the projecting ends.

On the other hand, as shown in FIG. 10, two first receiving portions 31 are formed on the opposite side walls 25 of the mounting frame 27 at substantially the same height, and two second receiving portions 32 are formed at substantially the same height above and at a specified distance from the first receiving portions 31. The receiving portions 31, 32 are rectangular holes of identical shape and size that penetrate the side walls 25 in a thickness direction and can receive the respective first and second latches 55, 56. Front parts of the first and second receiving portions 31, 32 are partitioned by disengagement preventing walls 33 formed by thinning the outer surfaces of the side walls 25 to prevent front wall member 50 from coming off forward.

Figure 1:
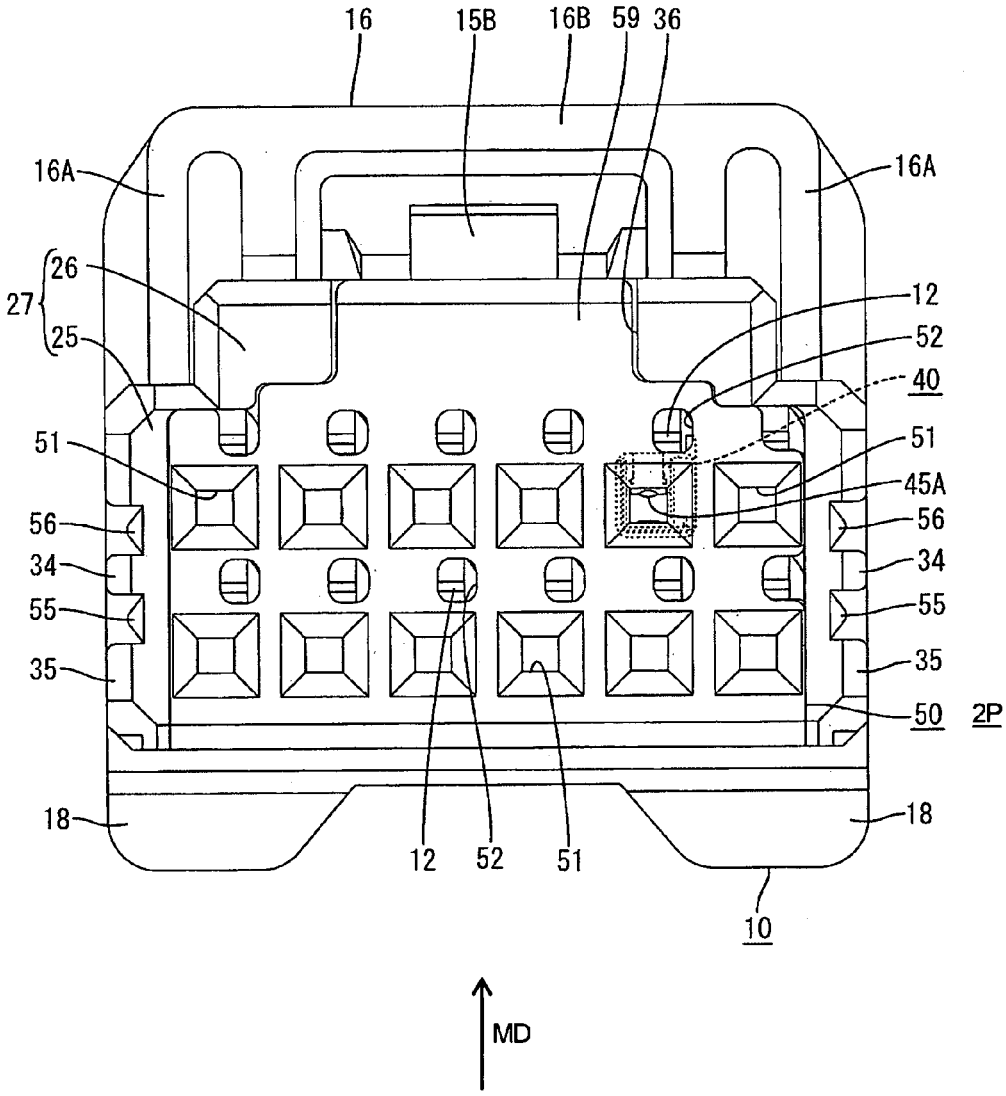
FIG. 1 is a front view of a connector according to a first embodiment of the invention when a front wall is at a full locking position.
Figure 2:
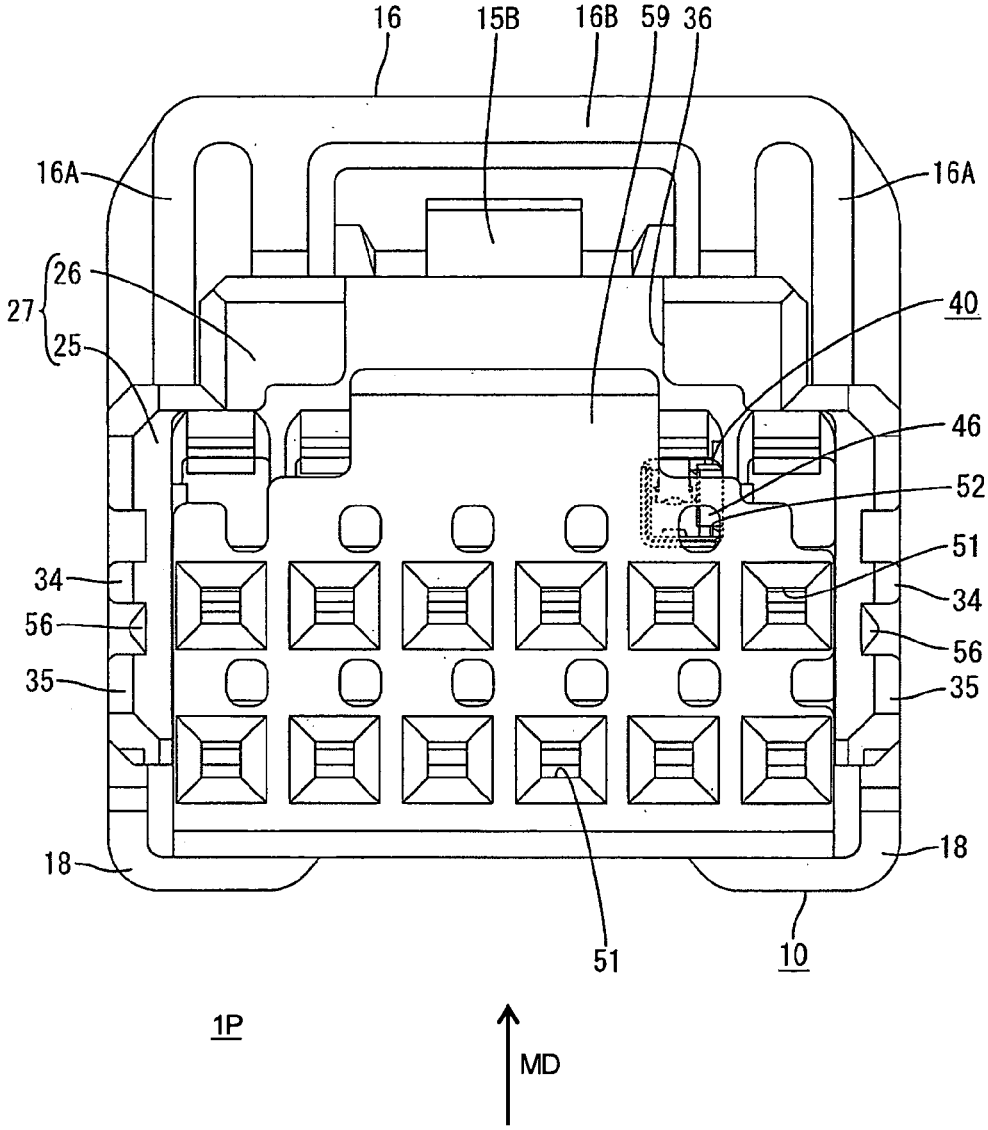
FIG. 2 is a front view of the connector when the front wall is at a partial locking position.

The front wall 50 is held at the partial locking position 1P by resiliently fitting the second latches 56 into the first receiving portions 31 as shown in FIG. 2 while being held at the full locking position 2P by resiliently fitting the second latches 56 into the second receiving portions 32 and the first latches 55 into the first receiving portions 31, as shown in FIG. 1. As a result, the front wall 50 is movable substantially up and down along the mounting direction MD between the partial locking position 1P and the full locking position 2P. In the process of moving the front wall 50 from the partial locking position 1P to the full locking position 2P, the second latches 56 move over partition walls 34 between the first and second receiving portions 31, 32 while resiliently pushing the partial walls 34 out. Thus, the first latches 55 move over end walls 35 below the first receiving portions 31 while pushing the end walls 35 out. The first and second latches 55, 56 can smoothly move over the partition walls 34 and the end walls 35 by bringing the slanted surfaces 57 as the upper surfaces of the first and second latches 55, 56 into sliding contact with the lower surfaces of the partition walls 34 and the end walls 35. Likewise, in the process of moving the front wall 50 from the full locking position 2P to the partial locking position 1P, the first and second latches 55, 56 can move smoothly over the partition walls 34 and the end walls 35 by bringing the slanted lower surfaces 58 of the first and second latches 55, 56 into sliding contact with the upper surfaces of the partition walls 34 and the end walls 35.

The front surface of the front wall 50 is substantially continuous and flush with the front surface of the mounting frame 27 and the lower surface of the front wall 50 is substantially continuous and flush with the bottom surface of the female housing 10 when the front wall 50 reaches the full locking position 2P. Further, a guide hole 36 vertically penetrates the upper wall 26 of the mounting frame 27. At least one pressing projection 59 is formed at the upper end as seen in the mounting direction MD of the front wall 50 and can fit into the guide groove 36. The pressing projection 59 is fit into the guide groove 36 and the upper end is exposed at the upper surface of the female housing 10 when the front wall 50 reaches the full locking position 2P, as shown in FIG. 1. The front wall 50 can be moved to the partial locking position 1P by pressing this exposed upper end down in a direction substantially opposite to the mounting direction MD.

The tab insertion holes 51 communicate with the cavities 11 and the jig insertion holes 52 communicate with the mold-removal holes 14 when the front wall 50 reaches the full locking position 2P. Accordingly, the tabs 70 can be inserted into the tab insertion holes 51 from the front in this state. Thus, the leading ends of the tabs 70 pass through the tab insertion holes 51 and enter the main portions 41 of the female terminal fittings 40 in the cavities 11 to contacting the resilient contacts 45 in the main portions 41 and to establish electrical connection. An unlocking jig (not shown) for disengaging the lock 12 from the female terminal fitting 40 can be inserted into the jig insertion hole 52 from the front so that the leading end of the jig enters the mold-removal hole 14 to contact with the front surface of the locking projection 12A at the leading end of the lock 12. As a result, the lock 12 can be pushed up towards the deformation space 13 in the unlocking direction.

The tab insertion holes 51 are displaced from the cavities 11 when the front wall 50 is at the partial locking position 1P shown in FIG. 2. Thus, the tabs 70 cannot enter the main portions 41 of the female terminal fittings 40 even if inserted into the displaced tab insertion holes 51. Further, the front lower parts of the detecting plates 46 of the female terminal fittings 40 face the jig insertion holes 52. Thus, detection probes 60 can be inserted into the jig insertion holes 52 from the front, and leading ends of the probes 60 contact the front lower parts of the detecting plates 46. Whether the female terminal fittings 40 are inserted properly in the cavities 11 can be detected based on electrical connections between the probes 60 and the detecting plates 46.

The front wall 50 first is fit loosely into the mounting frame 27 from below and along the mounting direction MD. In this state, the front 50 is pushed in the mounting direction MD to let the second latches 56 resiliently move over the end walls 35 of the female housing 10 and to fit the second latches 56 into the first receiving portions 31. Thus, the front wall 50 is at the partial locking position 1P, as shown in FIG. 2. The front wall 50 can be moved towards the full locking position 2P as shown in FIG. 1 by pushing the front wall 50 up in the mounting direction MD to fit the second latches 56 into the second receiving portions 32 and to fit the first latches 55 into the first receiving portions 31. Subsequently or concurrently, the retainer 90 is set in the female housing 10 and held at the partial locking position.

The female terminal fitting 40 then is inserted into the cavity 11 from behind and is locked by the lock 12. At this time, a part of the rear surface of the front wall 50 around the tab insertion hole 51 faces the front edge of the female terminal fitting 40. After the insertion of all the female terminal fittings 40 is completed, the retainer 90 is pushed obliquely up and forward in the inserting direction to the full locking position for doubly locking the female terminal fittings 40. In this state, the tab insertion holes 51 of the front wall 50 substantially align with the tab insertion openings 41G of the main portions 41 of the female terminal fittings 40, and the jig insertion holes 52 of the front wall 50 communicate with the mold-removal holes 14 of the female housing 10.

The male connector housing then is connected from the front so that the tabs 70 of the male terminal fittings pass through the tab insertion holes 51 of the front wall 50 and enter the main portions 41 of the respective female terminal fittings 40, as shown in FIG. 5. The tabs 70 could enter at positions displaced from proper position due to an error in positioning the two housings. However, the displaced tabs 70 will contact the opening edges of the tab insertion holes 51. Accordingly, the erroneous entrance of the tabs 70 into the mold-removal holes 14 can be prevented. In addition, slanted surfaces 51A for guiding the tabs 70 are formed around the tab insertion holes 51 in the front surface of the front wall 50. Thus, the positions of the tabs 70 are corrected to guide the tabs 70 into the main portions 41 of the female terminal fittings 40.

The retainer 90 is returned to the partial locking position or detached to remove the female terminal fittings 40. An unlocking jig then is inserted through the jig insertion hole 52 from the front and enters the mold-removal hole 14 to bring the leading end of the jig into contact with the leading end of the lock 12. As a result, the lock 12 can be deflected up towards the deformation space 13. After being disengaged from the lock 12, the female terminal fitting 40 is withdrawn.

Figure 6:
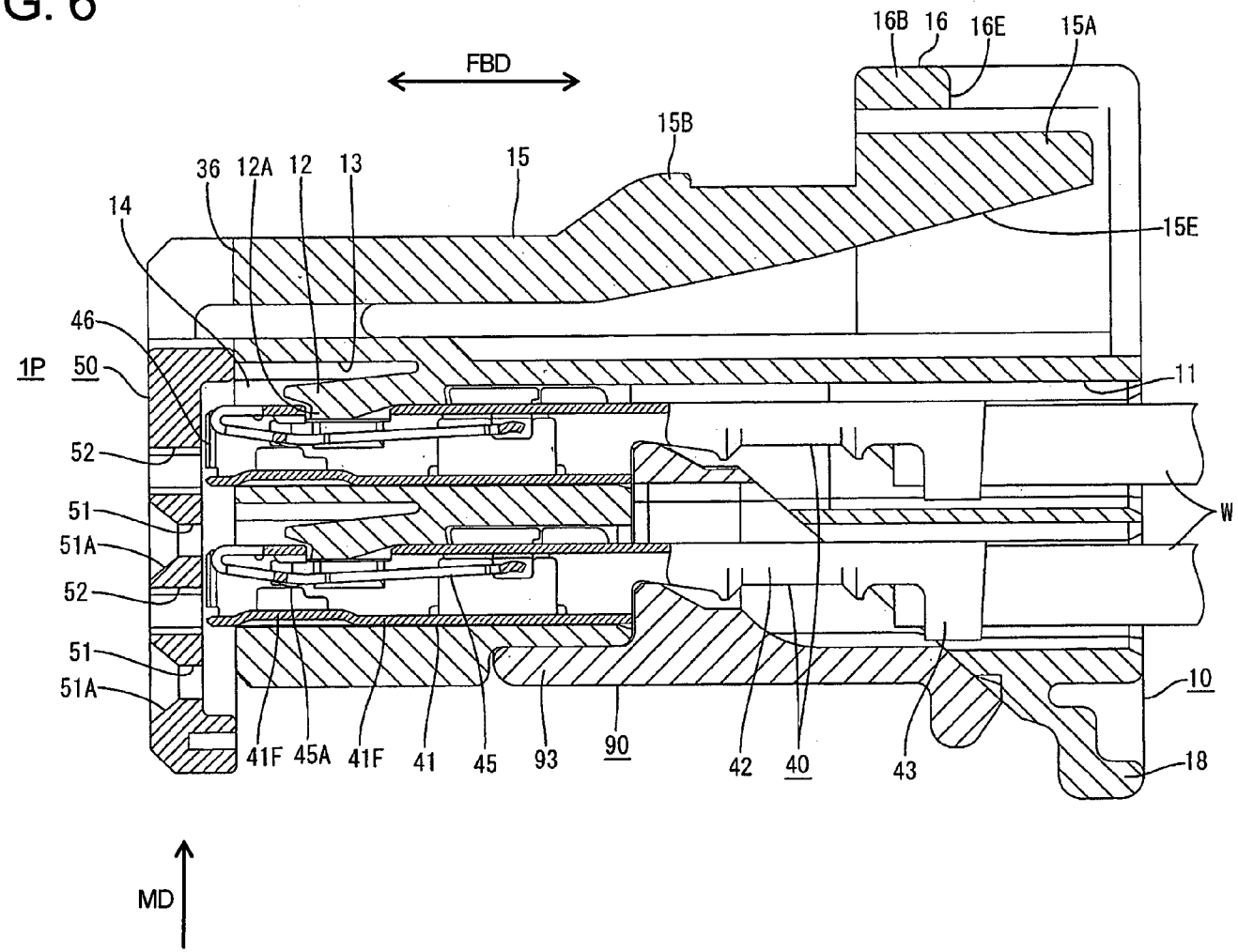
FIG. 6 is a section of the connector when the front wall is at the partial locking position.
Figure 7:
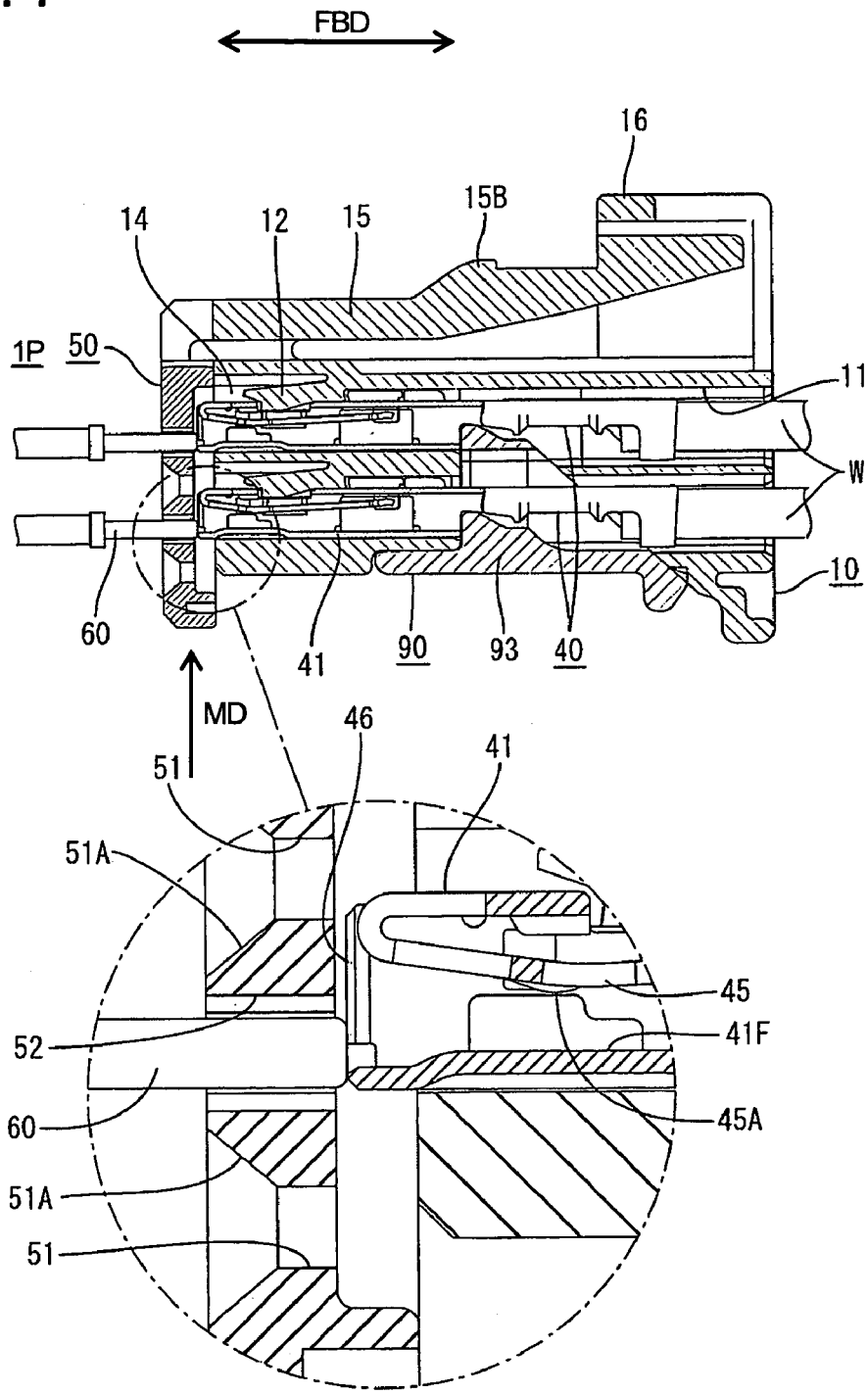
FIG. 7 is a section of the connector when the front wall is at the partial locking position and detection probes are brought into contact.

To conduct an electrical connection test for the female terminal fittings 40, the front wall 50 is moved to the partial locking position 1P as shown in FIG. 6. At the partial locking position 1P, the jig insertion holes 52 of the front wall 50 align with the front lower parts of the detecting plates 46 of the female terminal fittings 40 in the cavities 11. As shown in FIG. 7, the detection probes 60 then are inserted through the jig insertion holes 52 of the front wall 50 from the front and contact with the detecting plates 46 to conduct the electrical connection test.

The tab insertion holes 51 are offset from the centers of the tab insertion openings 41G of the main portions 41 of the female terminal fittings 40 in the cavities 11 when the front wall 50 is at the partial locking position 1P. Accordingly, detection probes 60 that are inserted inadvertently into the tab insertion holes 51 of the front wall 50 in this state will contact the front edges of the terminal fittings or the front surface of the female housing 10 and cannot enter the main portions 41. As a result, the detection probes 60 cannot contact the resilient contacts 45.

As described above, the front wall 50 prevents erroneous insertion of the tabs 70. Thus, this construction is particularly effectively for small-size connectors where such an erroneous insertion of the tabs 70 is likely to occur.

Further, the detection probes 60 for electrical connection test pass through the jig insertion holes 52 of the front wall 50 at the partial locking position 1P and contact parts of the female terminal fittings 40 different from the resilient contacts 45. Thus, the electrical connection test can be conducted without touching the resilient contacts 45 and deformation of the resilient contacts 45 can be prevented during the electrical connection test. The detection probes 60 for electrical connection test could be inserted into the tab insertion holes 51, but they cannot enter the main portions 41. Thus, contact of the detection probes 60 and the resilient contacts 45 is prevented.

The jig insertion holes 52 function as through holes for permitting the unlocking jig to reach the lock 12 at the full locking position 2P of the front wall 50 while functioning as through holes for permitting the detection probes 60 to reach the front lower parts of the detecting plates 46 at the partial locking position 1P of the front wall 50. Thus, it is not necessary to form two kinds of such through holes, and the construction of the front wall 50 can be simplified.

The detection probes 60 contact the detecting plates 46 of the female terminal fittings 40 during the electrical connection test. Thus, large contact areas with the detection probes 60 can be ensured, thereby improving the reliability of the electrical connection test.

A second embodiment of the invention is described with reference to FIGS. 16 to 22. A connector of this embodiment has a female housing 10 connectable with a male connector housing (not shown), and a front wall 50 is coupled unitarily to the female housing 10 via one or more hinges 30 and is mountable on the front surface of the female housing 10. Thus, the second embodiment differs from the first embodiment in that the front wall member 50 is unitary to the female housing 10. In the following description, parts that are the same as or similar to the first embodiment are identified by the same reference numerals, but are not described again.

A mounting frame 27 projects from the front surface of the female housing 10. The mounting frame 27 is gate-shaped and has opposite side walls 25 and an upper wall 26 formed at the front surface of the female housing 10. The front wall 50 is made e.g. of a synthetic resin into a substantially flat plate, and is mounted onto the mounting frame 27 by being rotated.

Figure 19:
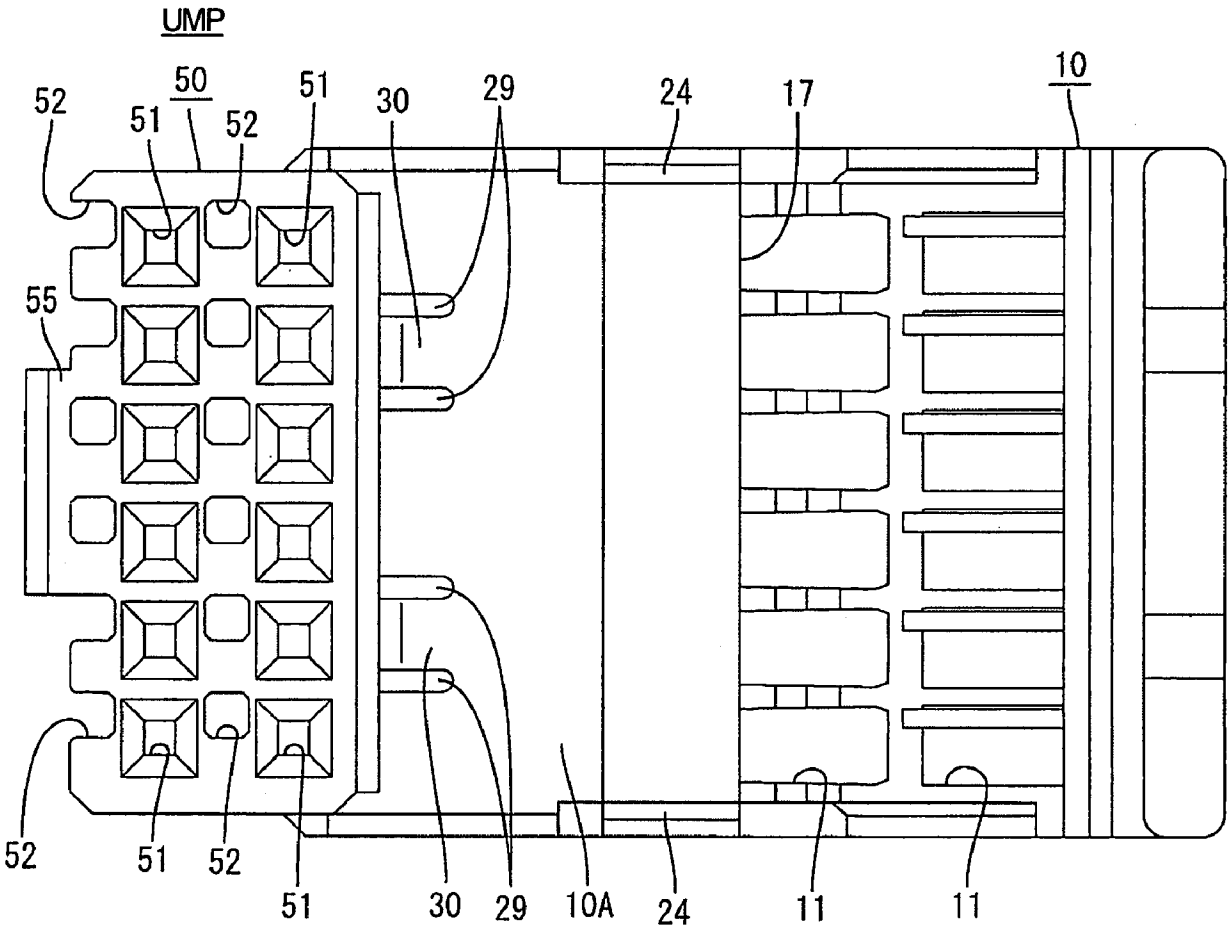
FIG. 19 is a bottom view showing a state before the front wall is mounted.
Figure 20:
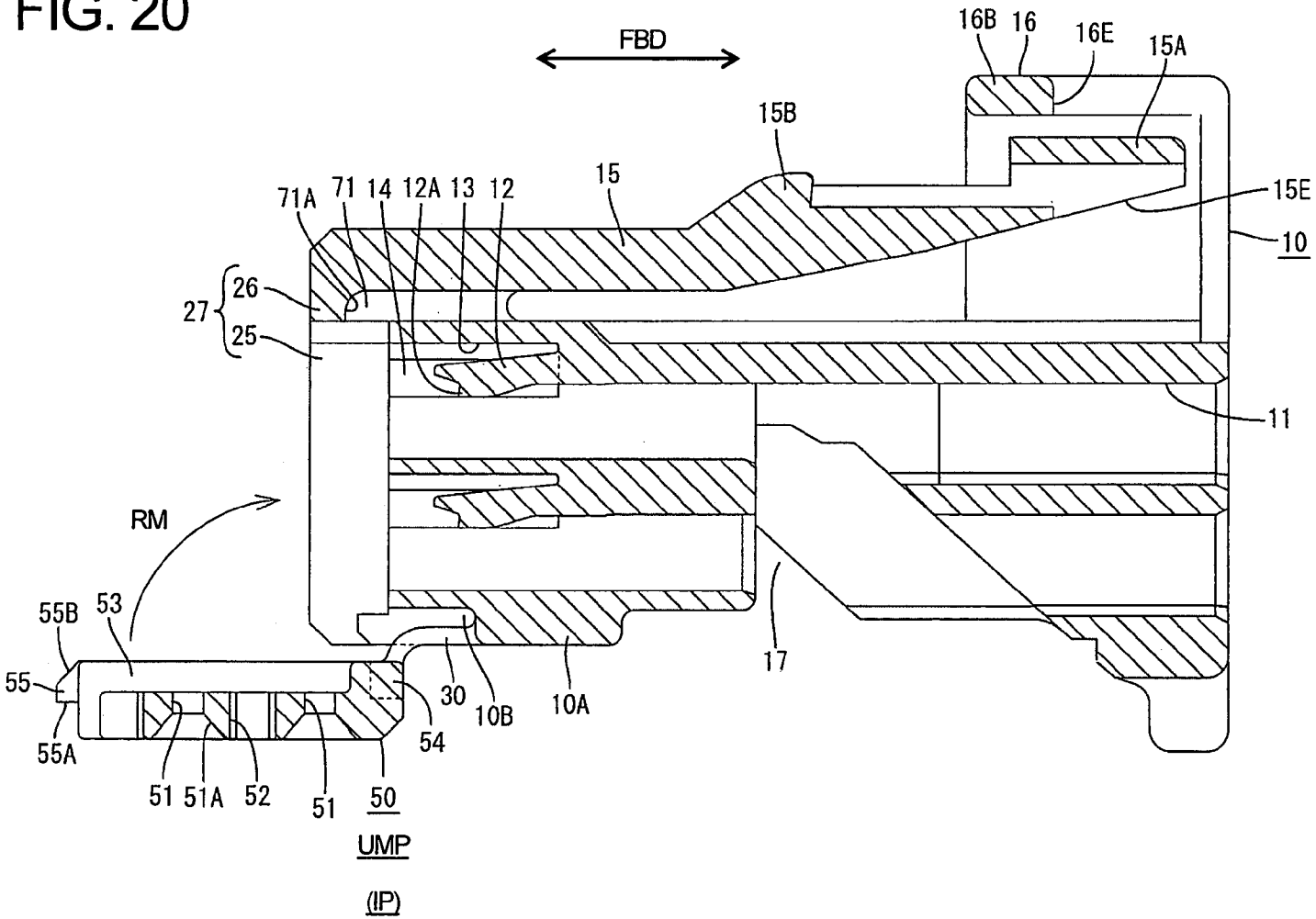
FIG. 20 is a section showing a state before the front wall is mounted.

The front wall 50 is formed to be unitary to the female housing 10 via hinges 30. As shown in FIG. 19, the hinges 30 are resiliently deformable and are formed between pairs of slits 29 having open front ends at two positions of a bottom wall 10A of the female housing 10 near the opposite sides. The lower surfaces of the hinges 30 are substantially continuous and flush with the bottom surface of the female housing 10, and the upper surfaces thereof are substantially at the bottoms of bored portions 10B formed at intermediate positions of the bottom wall 10A of the female housing 10 with respect to thickness direction as shown in FIG. 20. Therefore, the hinges 30 are made thin to ensure flexible resilient deformations.

The front wall 50 is supported rotatably by both hinges 30 by being connected to ends of the hinges 30 at two bottom positions near the opposite sides. Accordingly, the connected positions of the front wall 50 and the hinges 30 are more backward than the front end of the female housing 10 including the mounting frame 27, as shown in FIG. 20.

The front wall 50 is displaceable between a mounted position MP where the front wall 50 is mounted on the front surface of the female housing 10 and an unmounted position UMP where the front wall 50 is distanced from the front of the female housing 10 by being rotated about the hinges 30.

As shown in FIG. 20, the front wall 50 can be molded while being at an initial position IP where the front wall 50 assumes a horizontal posture by being rotated about the hinges 30 by about 90° in the opening direction from the mounted position MP and the tab insertion holes 51, the jig insertion holes 52 and the retainer mount holes 17 in the bottom surface of the female housing 10 are open in the same direction. Accordingly, the connector assumes the state shown in FIG. 20 when being molded. Therefore, upon molding the front wall 50, the tab insertion holes 51 and the jig insertion holes 52 can be formed using a mold for forming the retainer mount hole 17 (mold not shown) slidable along vertical direction in FIG. 20.

Figure 17:
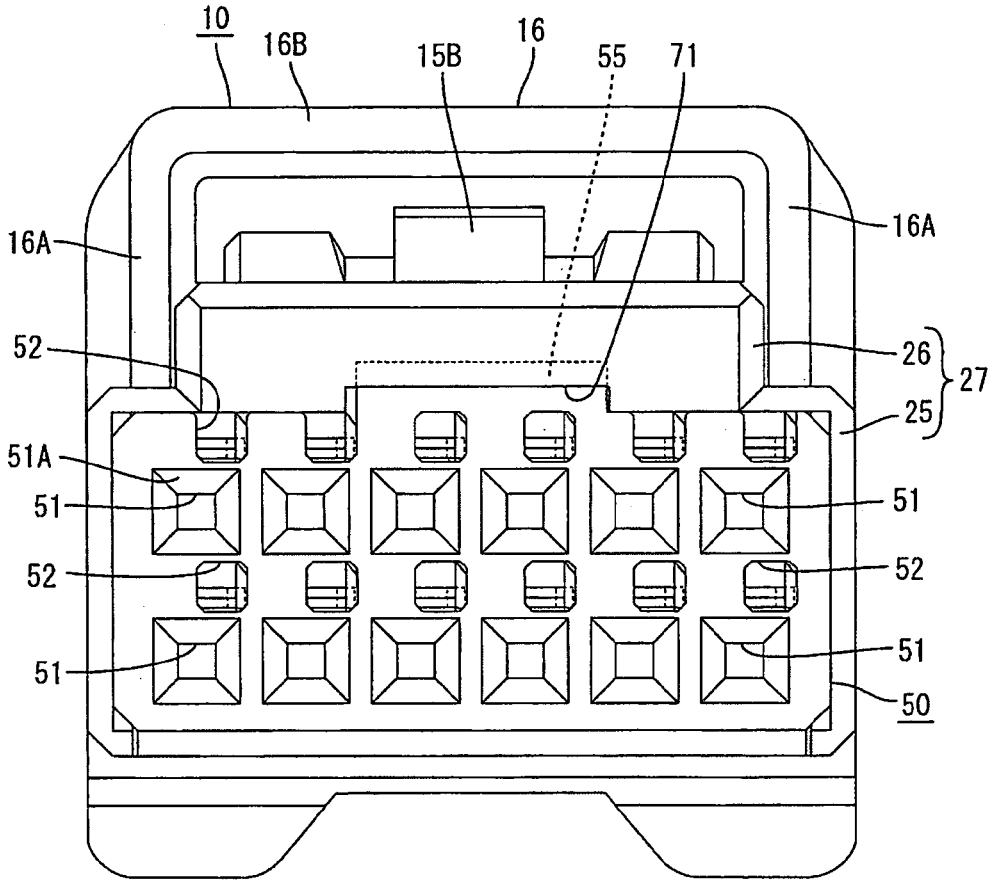
FIG. 17 is a front view of the connector showing a state where a front wall is mounted.
Figure 18:
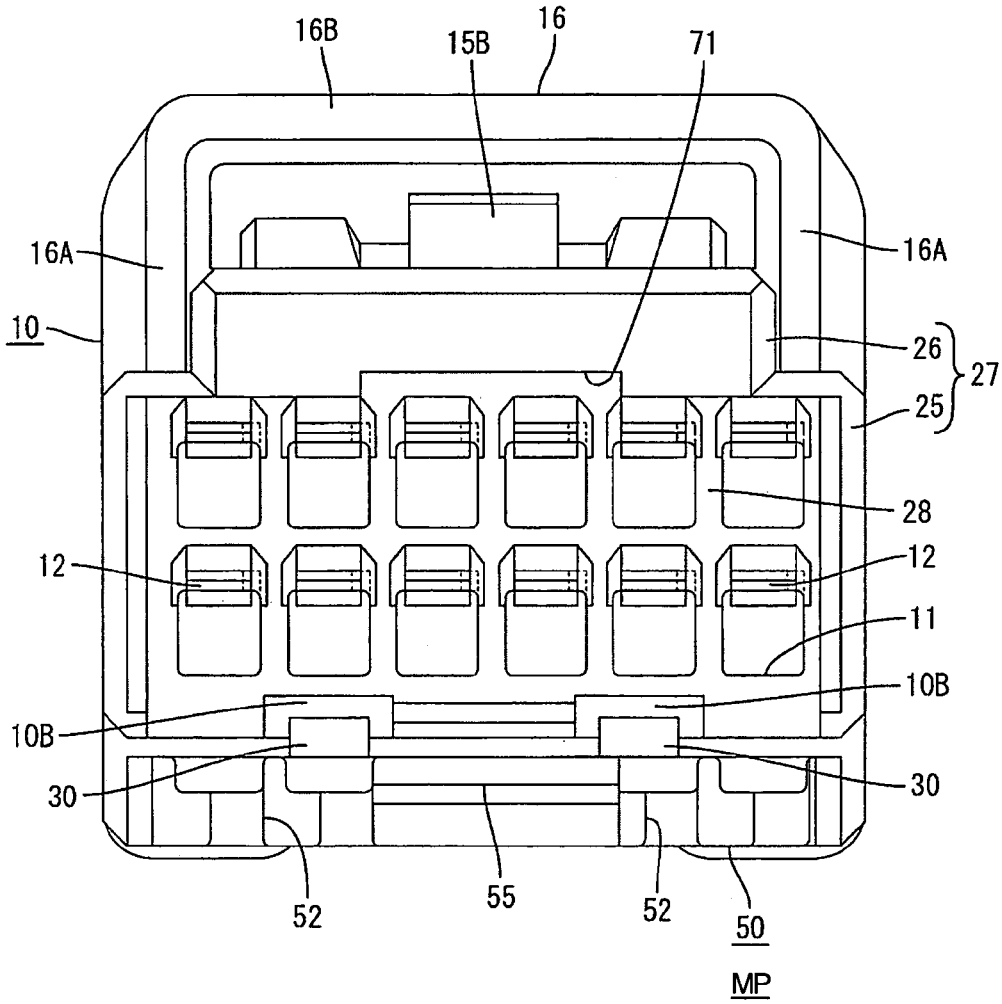
FIG. 18 is a front view showing a state before the front wall is mounted.
Figure 21:
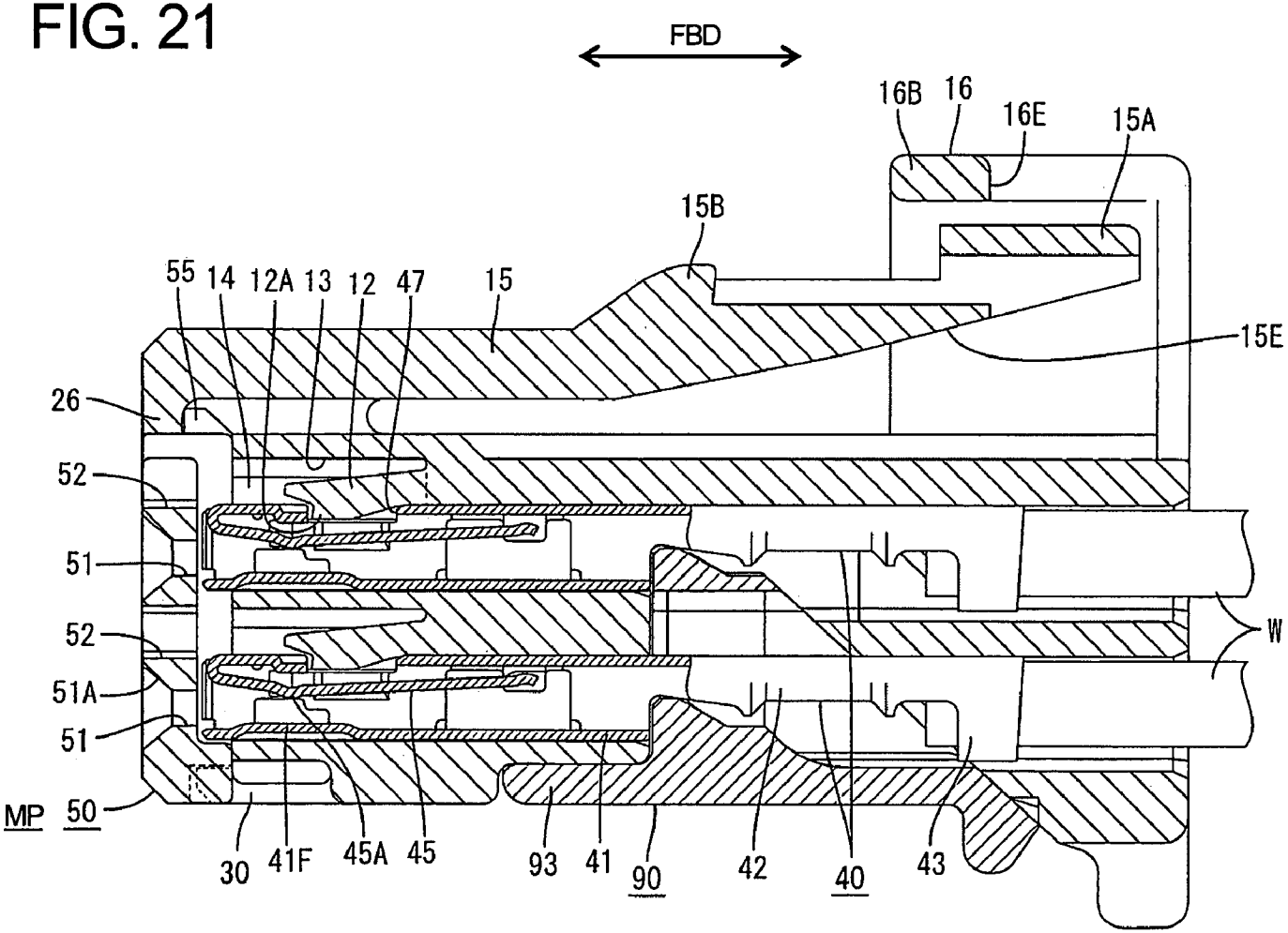
FIG. 21 is a section showing a state where the front wall is mounted.
Figure 22:
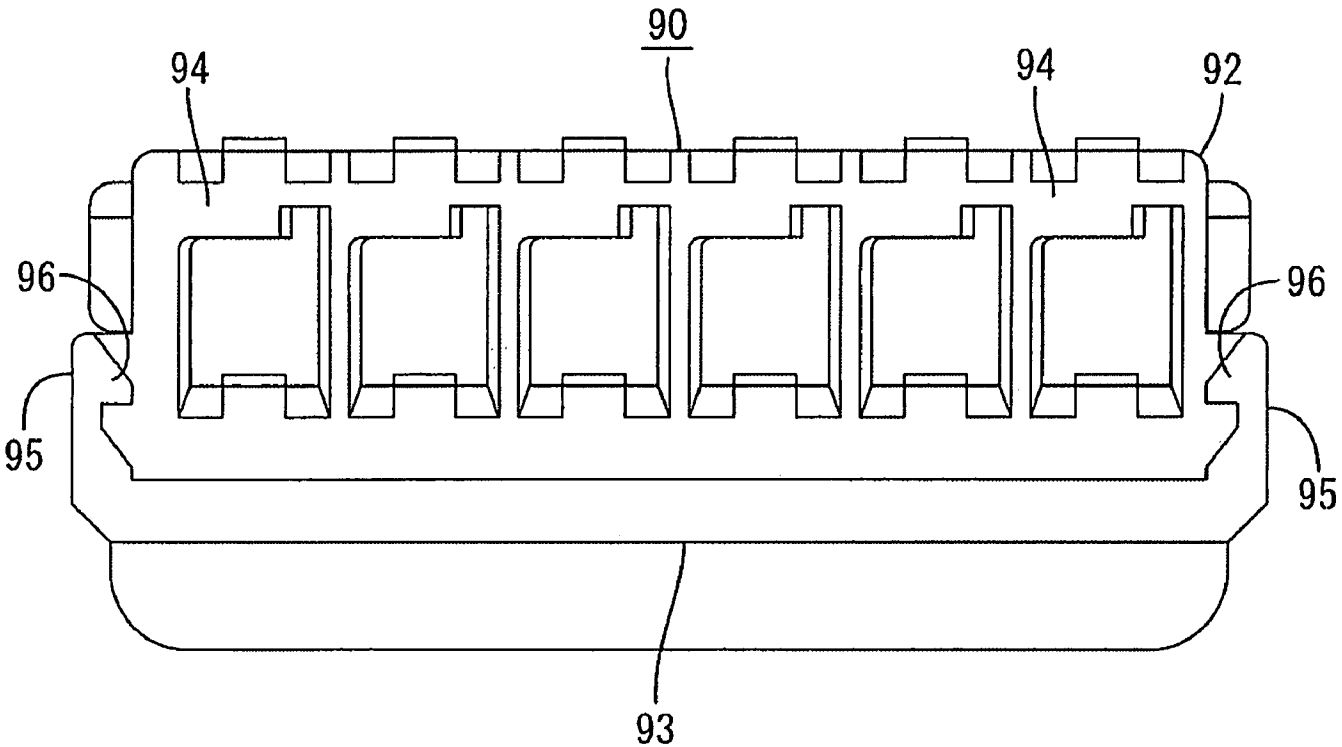
FIG. 22 is a front view of a retainer.

As shown in FIGS. 17 and 21, the front wall 50 fits into the mounting frame 27 at the mounted position MP. The front wall 50 is permitted to make substantially only rotary movements RM about the hinges 30. If the unmounted position UMP is a rotation starting position, the mounted position MP is a rotation ending position. Movement other than the rotary movement RM is not permitted. Hence, movement parallel to the mounting frame 27 towards the front of the female housing 10 after the rotation of the front wall 50 is not permitted. In this case, the hinges 30 deal with the rotation RM of the front wall 50 by resiliently deforming the connected portions with the front wall 50.

A lock piece 55 projects in a rear-half of the thickness of the front wall 50 at an intermediate position of the upper end of the front wall 50 (e.g. above two middle jig insertion holes 52 at the upper stage). The lock piece 55 has a wide shape with a base end connected with the vertical ribs 53. A front surface thereof is a substantially vertical locking surface 55A and the rear surface thereof is a slanted guide surface 55B inclined up towards the front.

The upper wall 26 of the mounting frame 27 has a receiving portion 71 in the form of a wide slit formed by recessing an intermediate portion of the base end of the lock arm 15. The receiving portion 71 is open in the rear surface of the base end of the lock arm 15 and in the lower surface of the upper wall 26. The lock piece 55 of the front wall 50 is fit resiliently into the receiving portion 71 when the front wall 50 reaches the mounted position MP, so that the front wall 50 can be retained. The front surface of the receiving portion 71 is a substantially vertical engaging surface 71A to ensure a strong locking force in cooperation with the locking surface 55A of the lock piece 55. The guide surface 55B of the lock piece 55 slides in contact with the lower surface of the upper wall 26 before the front wall 50 reaches the mounted position MP. Thus, the smooth rotation RM of the front wall 50 is ensured.

When the front wall 50 reaches the full locking position MP, the upper end and the opposite sides thereof are covered by the mounting frame 27 as shown in FIG. 17, the tab insertion holes 51 of the front wall 50 communicate with the cavities 11, and the jig insertion holes 52 communicate with the mold-removal holes 14. Accordingly, tabs can be inserted into the tab insertion holes 51 from the front in this state. Thus, the leading ends of the tabs pass through the tab insertion holes 51 and enter the main portions 41 of the female terminal fittings 40 in the cavities 11 to contact the resilient contacts 45 in the main portions 41 to establish electrical connections therebetween. On the other hand, an unlocking jig (not shown) for disengaging the lock 12 from the female terminal fitting 40 can be inserted into the jig insertion hole 52 from the front. Thus, the leading end of the jig enters the mold-removal hole 14 through the jig insertion hole 52 to contact the front surface of the locking projection 12A at the leading end of the lock 12. As a result, the lock 12 can be pushed up towards the deformation space 13 in the unlocking direction.

The front wall 50 at the unmounted position UMP is rotated about the hinges 30 in closing direction RD (direction of arrow in FIG. 20) to reach the mounted position MP. Thus, the front wall 50 is mounted to the female housing 10 through a one-touch operation because of the resilient engagement of the lock piece 55 and the receiving portion 71. At the mounted position MP, the side edges of the front wall 50 are covered by the mounting frame 27 so that the front wall 50 is hidden behind the mounting frame 27 when viewed from the side or above.

Subsequently or concurrently, the retainer 90 is set in the female housing 10 and held at the partial locking position. The female terminal fitting 40 is inserted into the cavity 11 from behind to a proper insertion position and is locked by the lock 12. At this time, a part of the rear surface of the front wall 50 around the tab insertion hole 51 functions as a front stop for the female terminal fitting 40 by being opposed to the front of the female terminal fitting 40. After the insertion of all the female terminal fittings 40 is completed, the retainer 90 is moved obliquely up and forward to the full locking position, thereby doubly locking the female terminal fittings 40.

In this state, the tab insertion holes 51 of the front wall 50 substantially align with the front openings of the main portions 41 of the female terminal fittings 40 and the jig insertion holes 52 of the front wall 50 communicate with the mold-removal holes 14 of the female housing 10 as shown in FIG. 21.

A mating male connector housing can be connected from front so that the tabs of the male terminal fittings pass through the tab insertion holes 51 of the front wall 50 and enter the main portions 41 of the female terminal fittings 40. The tabs may try to enter positions deviated from proper positions e.g. due to a positioning error between the two housings. Thus, the tabs are displaced from the tab insertion holes 51 of the front wall 50 to contact the opening edges of the tab insertion holes 51. Accordingly, the erroneous insertion of the tabs into the mold-removal holes 14 is prevented. Further, slanted surfaces 51A are formed in the front surface of the front wall 50 around the tab insertion holes 51 for guiding the tabs. Thus, displacements of the tabs are corrected to guide the tabs into the main portions 41 of the female terminal fittings 40.

Upon withdrawing the female terminal fitting 40, the unlocking jig is inserted into the jig insertion hole 52 from the front after the retainer 90 is returned to the partial locking position or detached from the female housing 10. Then, the unlocking jig is inserted into the mold-removal hole 14 through the jig insertion hole 52 to bring the leading end thereof into contact with the leading end of the lock 12. The lock 12 can be displaced up toward the deformation space 13. The female terminal fitting 40 is pulled out after being disengaged from the lock 12.

As described above, the front wall 50 is unitary with the female housing 10 and the hinges 30. Thus, it is not necessary to separately form the front wall 50 and the female housing 10, thereby reducing the number of parts and making it easier to mold the connector.

Further, since the front wall 50 is rotatable about the hinges 30 and the rotation ending position thereof along closing direction is the mounted position MP on the female housing 10, the front wall 50 can be mounted on the front surface of the female housing 10 through one movement, improving mounting operability.

The position of the front wall 50 reached by rotating the front wall 50 by about 90° in opening direction from the mounted position MP is the initial position (IP) and the tab insertion holes 51 and the retainer mount hole 17 are open in the substantially same direction at this initial position IP. Thus, the mold can be simplified by setting the posture of the housing at the time of molding to the one where the front wall 50 is at the initial position IP.

When the front wall 50 is mounted on the front surface of the female housing 10, the side edges thereof are protected by the mounting frame 27. Thus, the front wall 50 will not be detached inadvertently from the front surface of the female housing 10 due to the intrusion of an external matter.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Although the front lower part of the detecting plate serves as the detecting portion for the electrical connection test in the first embodiment, a front upper part of the detecting plate or a part of the main portion except the resilient contact piece may serve as the detecting portion for the electrical connection test according to the present invention.

Although the hinges are formed to have a rigidity to be substantially unfoldable in the second embodiment, they may be formed to have such a length as to be foldable according to the present invention.

Although two hinges are provided in the second embodiment, one, three or more hinges may be provided according to the present invention.

Although the connector into which the retainer is mounted is shown in the first and second embodiments, the invention is also applicable to connectors with no retainer.

What is claimed is:

1. A connector comprising a housing formed with at least one cavity for receiving a terminal fitting, the terminal fitting including a main portion for receiving a tab of a mating terminal, a resilient contact in the main portion and configured for contacting the tab and a detecting portion for at least partly covering a front opening of the main portion except an area for receiving the tab, a lock formed at an inner wall of the cavity and being engageable with the terminal fitting to lock the terminal fitting in the cavity, a mold-removal hole formed in a front end of the housing and substantially aligned with the lock, a front wall mountable on the front end of the housing and having at least one tab insertion hole that can communicate with the cavity, the front wall having at least one jig insertion hole for permitting insertion of an unlocking jig for disengaging the lock from the housing, the front wall being movable on the housing between a first position where the detecting portion substantially faces the jig insertion hole and a second position where the tab insertion hole communicates with the cavity and the jig insertion hole communicates with the mold removable hole, wherein the jig for an electrical connection test can be inserted into the jig insertion hole for contacting the detecting portion when the front wall is at the first position.

2. The connector of claim 1, wherein the tab can enter the main portion through the tab insertion hole to contact a resilient contact of the terminal fitting in the cavity, and an unlocking jig can be inserted into the mold-removal hole through the jig insertion hole to resiliently displace the lock in an unlocking direction when the front wall is at the second position.

3. The connector of claim 1, wherein, when the front wall is at the first position, a front opening of the main portion and the tab insertion hole are displaced from each other, and the leading end of the jig for electrical connection test cannot enter the main portion.

4. The connector of claim 1, wherein the front wall is formed unitary to the housing via at least one hinge.

5. The connector of claim 1, wherein at least one part of a surface of the front wall substantially facing the housing and at least partly around the tab insertion hole defines a front stop wall for the terminal fitting when the terminal fitting is being inserted into the cavity.

6. The connector of claim 4, wherein the front wall is supported rotatably about the hinge and is mounted on the front surface of the housing when being rotated in closing direction to reach a rotation ending position.

7. A connector comprising a housing formed with at least one cavity for receiving a terminal fitting, a lock formed at an inner wall of the cavity and being engageable with the terminal fitting to lock the terminal fitting in the cavity, a front wall mountable on a front end of the housing and having at least one tab insertion hole that can communicate with the cavity, the front wall being formed unitary to the housing via at least one hinge, a retainer mount hole formed in a side surface of the housing and configured for receiving a retainer for retaining the terminal fitting in the cavity, the front wall be rotatable in an opening direction to an initial position so that the tab insertion hole and the retainer mount hole are open in a substantially common direction.

8. A connector, a housing formed with at least one cavity for receiving a terminal fitting, a lock formed at an inner wall of the cavity and being engageable with the terminal fitting to lock the terminal fitting in the cavity, a front wall mountable on a front end of the housing and having at least one tab insertion hole that can communicate with the cavity, the front wall being formed unitary to the housing via at least one hinge, wherein a mounting frame is mounted on the front of the housing for at least partly covering side edges of the front wall in at least one rotational position of the front wall.

* * * * *